US010240286B2

(12) United States Patent
Chung et al.

(10) Patent No.: US 10,240,286 B2
(45) Date of Patent: Mar. 26, 2019

(54) DIE PRESS ASSEMBLY FOR DRYING AND CUTTING MOLDED FIBER PARTS

(71) Applicant: Footprint International, LLC, Scottsdale, AZ (US)

(72) Inventors: Yoke Dou Chung, Chandler, AZ (US); Michael Theodore Lembeck, San Tan Valley, AZ (US)

(73) Assignee: Footprint International, LLC, Gilbert, AZ (US)

( * ) Notice: Subject to any disclaimer, the term of this patent is extended or adjusted under 35 U.S.C. 154(b) by 2 days.

(21) Appl. No.: 15/606,992

(22) Filed: May 26, 2017

(65) Prior Publication Data

US 2018/0340296 A1 Nov. 29, 2018

(51) Int. Cl.

| | |
|---|---|
| ***D21B 1/16*** | (2006.01) |
| ***D21B 1/26*** | (2006.01) |
| ***D21J 3/00*** | (2006.01) |
| ***D21J 7/00*** | (2006.01) |
| *D21H 11/14* | (2006.01) |
| *D21H 17/17* | (2006.01) |
| *D21H 17/29* | (2006.01) |

(52) U.S. Cl.

CPC ..... *D21B 1/16* (2013.01); *D21J 3/00* (2013.01); *D21J 7/00* (2013.01); *D21B 1/26* (2013.01); *D21H 11/14* (2013.01); *D21H 17/17* (2013.01); *D21H 17/29* (2013.01)

(58) Field of Classification Search

CPC ..... D21J 7/00; D21J 5/00; D21J 3/00; D21J 3/12; B31B 2110/10; B31B 2110/20; B31B 50/142; B31B 50/592; Y10S 425/014; B30B 7/00; B65D 65/466; B29C 37/0007; B29C 51/32; B29C 51/44

See application file for complete search history.

(56) References Cited

U.S. PATENT DOCUMENTS 3,041,669 A * 7/1962 Marshall ..... B29C 51/325 264/553
3,357,053 A * 12/1967 Lyon ..... B29C 51/04 264/294
3,567,575 A 3/1971 Emery (Continued)

FOREIGN PATENT DOCUMENTS

| | | |
|---|---|---|
| CN | 1103451 | 6/1995 |
| JP | 05050512 A * | 3/1993 |
| WO | 2016123701 | 8/2016 |

OTHER PUBLICATIONS

International Search Report, PCT/US18/34176 dated Sep. 26, 2018; 3pgs.

Written Opinion, PCT/US18/34176 dated Sep. 26, 2018; 7pgs.

*Primary Examiner* — Jose A Fortuna

(74) *Attorney, Agent, or Firm* — Jennings, Strouss & Salmon PLC; Michael K. Kelly; Daniel R. Pote

(57) ABSTRACT

Methods and apparatus for fabricating a molded fiber part. The die press assembly includes: a first plate having a first mold form and a first plurality of vent holes; and a second plate having a second mold form and a second plurality of vent holes; wherein: at least one of the first and second plates comprises a blade operable to cut the part; the die press assembly is configured to compress the molded fiber part between the first and second mold forms; and the first and second pluralities of vent holes are configured to remove moisture from the part.

14 Claims, 21 Drawing Sheets

(56) References Cited

U.S. PATENT DOCUMENTS 4,088,259 A * 5/1978 Sutton ..... B65D 85/324 162/392
4,755,128 A * 7/1988 Alexander ..... B29C 37/0007 249/66.1
4,755,129 A * 7/1988 Baker ..... B29C 51/32 264/160
5,385,764 A * 1/1995 Andersen ..... B01F 3/1214 106/675
6,210,531 B1 * 4/2001 Bradford ..... B29C 43/56 162/218
6,352,617 B1 * 3/2002 Lee ..... D21J 7/00 162/218
6,461,480 B1 * 10/2002 Otakura ..... D21J 3/10 162/220
6,468,398 B1 * 10/2002 Kumamoto ..... D21J 3/10 162/220
6,576,089 B1 * 6/2003 Sato ..... D21J 3/10 162/227
9,856,608 B1 * 1/2018 Chung ..... B05D 1/02
9,869,062 B1 * 1/2018 Chung ..... B65D 65/466
2003/0136537 A1 7/2003 Frederiksen et al.
2004/0041305 A1 * 3/2004 Tsuura ..... D21J 3/10 264/335
2004/0045690 A1 * 3/2004 Eto ..... D21J 3/10 162/225
2004/0241274 A1 * 12/2004 Odajima ..... D21J 3/00 425/389
2005/0150624 A1 * 7/2005 Toh ..... D21B 1/00 162/218
2007/0212505 A1 9/2007 Dijstra et al.
2007/0227680 A1 * 10/2007 Kim ..... B31D 5/02 162/218
2009/0139678 A1 * 6/2009 Nilsson ..... D21J 3/00 162/226
2010/0310893 A1 * 12/2010 Derbyshire ..... B32B 21/02 428/528
2012/0305210 A1 * 12/2012 Nilsson ..... B22F 5/007 162/382
2012/0312492 A1 * 12/2012 Nilsson ..... D21J 3/00 162/382
2014/0096487 A1 4/2014 Nolsen et al.
2015/0033624 A1 2/2015 Fertil
2015/0145182 A1 * 5/2015 Jones ..... B29C 70/345 264/571
2015/0292154 A1 * 10/2015 Zheng et al. ..... D21J 5/00 162/226
2016/0168793 A1 * 6/2016 Kuo ..... D21J 3/12 162/227
2016/0319490 A1 * 11/2016 Wang ..... D21J 7/00
2018/0029765 A1 * 2/2018 Chung ..... B65D 65/466
2018/0029766 A1 * 2/2018 Chung ..... B65D 81/057
2018/0029767 A1 * 2/2018 Chung ..... D21H 17/29
2018/0339826 A1 * 11/2018 Chung ..... B65D 65/466
2018/0340296 A1 * 11/2018 Chung ..... D21B 1/16

* cited by examiner

DIE PRESS ASSEMBLY FOR DRYING AND CUTTING MOLDED FIBER PARTS

TECHNICAL FIELD

The present invention relates, generally, to vacuum forming of molded fiber containers and, more particularly, to in-line systems and methods for die cutting the containers during the drying process.

BACKGROUND

Sustainable solutions for reducing plastic pollution must not only be good for the environment, but also competitive with plastics in terms of both cost and performance. The present invention involves vacuum forming molded fiber containers, and trimming and otherwise removing excess fiber material during the drying stage of manufacture.

Molded paper pulp (molded fiber) can be produced from old newsprint, corrugated boxes and other plant fibers. Today, molded pulp packaging is widely used for electronics, household goods, automotive parts and medical products, and as an edge/corner protector or pallet tray for shipping electronic and other fragile components. Molds are made by machining a metal tool in the shape of a mirror image of the finished package. Holes are drilled through the tool and then a screen is attached to its surface. The vacuum is drawn through the holes while the screen prevents the pulp from clogging the holes.

The two most common types of molded pulp are classified as Type 1 and Type 2. Type 1 is commonly used for support packaging applications with 3/16 inch (4.7 mm) to ½ inch (12.7 mm) walls. Type 1 molded pulp manufacturing, also known as "dry" manufacturing, uses a fiber slurry made from ground newsprint, kraft paper or other fibers dissolved in water. A mold mounted on a platen is dipped or submerged in the slurry and a vacuum is applied to the generally convex backside. The vacuum pulls the slurry onto the mold to form the shape of the package. While still under the vacuum, the mold is removed from the slurry tank, allowing the water to drain from the pulp. Air is then blown through the tool to eject the molded fiber piece. The part is typically deposited on a conveyor that moves through a drying oven.

Type 2 molded pulp manufacturing, also known as "wet" manufacturing, is typically used for packaging electronic equipment, cellular phones and household items with containers that have 0.02 inch (0.5 mm) to 0.06 inch (1.5 mm) walls. Type 2 molded pulp uses the same material and follows the same basic process as Type 1 manufacturing up the point where the vacuum pulls the slurry onto the mold. After this step, a transfer mold mates with the fiber package on the side opposite of the original mold, moves the formed "wet part" to a hot press, and compresses and dries the fiber material to increase density and provide a smooth external surface finish. See, for example, http://www.stratasys.com/solutions/additive-manufacturing/tooling/molded-fiber; http://www.keiding.com/molded-fiber/manufactoring-process/; Grenidea Technologies PTE Ltd. European Patent Publication Number EP 1492926 B1 published Apr. 11, 2007 and entitled "Improved Molded Fiber Manufacturing"; and http://afpackaging.com/thermoformed-fiber-molded-pulp/. The entire contents of all of the foregoing are hereby incorporated by this reference.

Presently know techniques for vacuum forming fiber-based, molded pulp packaging products (e.g., food containers) do not contemplate in-line die cutting of the container.

Methods and apparatus are thus needed which overcome the limitations of the prior art.

Various features and characteristics will also become apparent from the subsequent detailed description and the appended claims, taken in conjunction with the accompanying drawings and this background section.

BRIEF SUMMARY

Various embodiments of the present invention relate to systems and methods for manufacturing vacuum molded, fiber-based packaging and container products using in-line die cutting to trim excess molded fiber and to otherwise configure the final part, for example by punching vent holes into bowels for steaming food. In various embodiments the die cutting may occur at any stage between the time the molded part is removed from the slurry bath, and the final drying stage. On the one hand, the part should be sufficiently dry before cutting to maintain structural rigidity during the cutting process. However, it generally requires sufficiently less force to cut the part when it is still moist. In one embodiment, the part may be die cut while still moist when cutting is easier, requiring in the range of twenty tons of applied force. Alternatively, the part may be fully or near fully dried and, hence, more structurally rigid before die cutting which may require in the range of one thousand tons of applied force.

According to a further aspect of the invention, the in-line die cutting is performed at the high temperatures used to remove moisture from the part, such as 150 to 250 degrees (Centigrade). Those skilled in the art will appreciate that operating die press equipment at high temperatures involves compensating for thermal expansion characteristics of the various metal components which are typically manufactured at room temperature. This can be particularly challenging when using both stainless steel and aluminum components in the same die equipment operated at high temperature, in view of the differential thermal expansion coefficients of the different materials.

It should be noted that the various inventions described herein, while illustrated in the context of conventional slurry-based vacuum form processes, are not so limited. Those skilled in the art will appreciate that the inventions described herein may contemplate any fiber-based manufacturing modality, including 3D printing techniques. Moreover, the molded fiber parts and the die molds used to manufacture them may exhibit any desirable configuration such as, for example, the containers disclosed in U.S. Ser. No. 15/220,371 filed Jul. 26, 2016 and entitled "Methods and Apparatus for Manufacturing Fiber-Based Produce Containers," the entire contents of which are hereby incorporated by reference.

Various other embodiments, aspects, and features are described in greater detail below.

BRIEF DESCRIPTION OF THE DRAWING FIGURES

Exemplary embodiments will hereinafter be described in conjunction with the appended drawing figures, wherein like numerals denote like elements, and:

Figure 17:
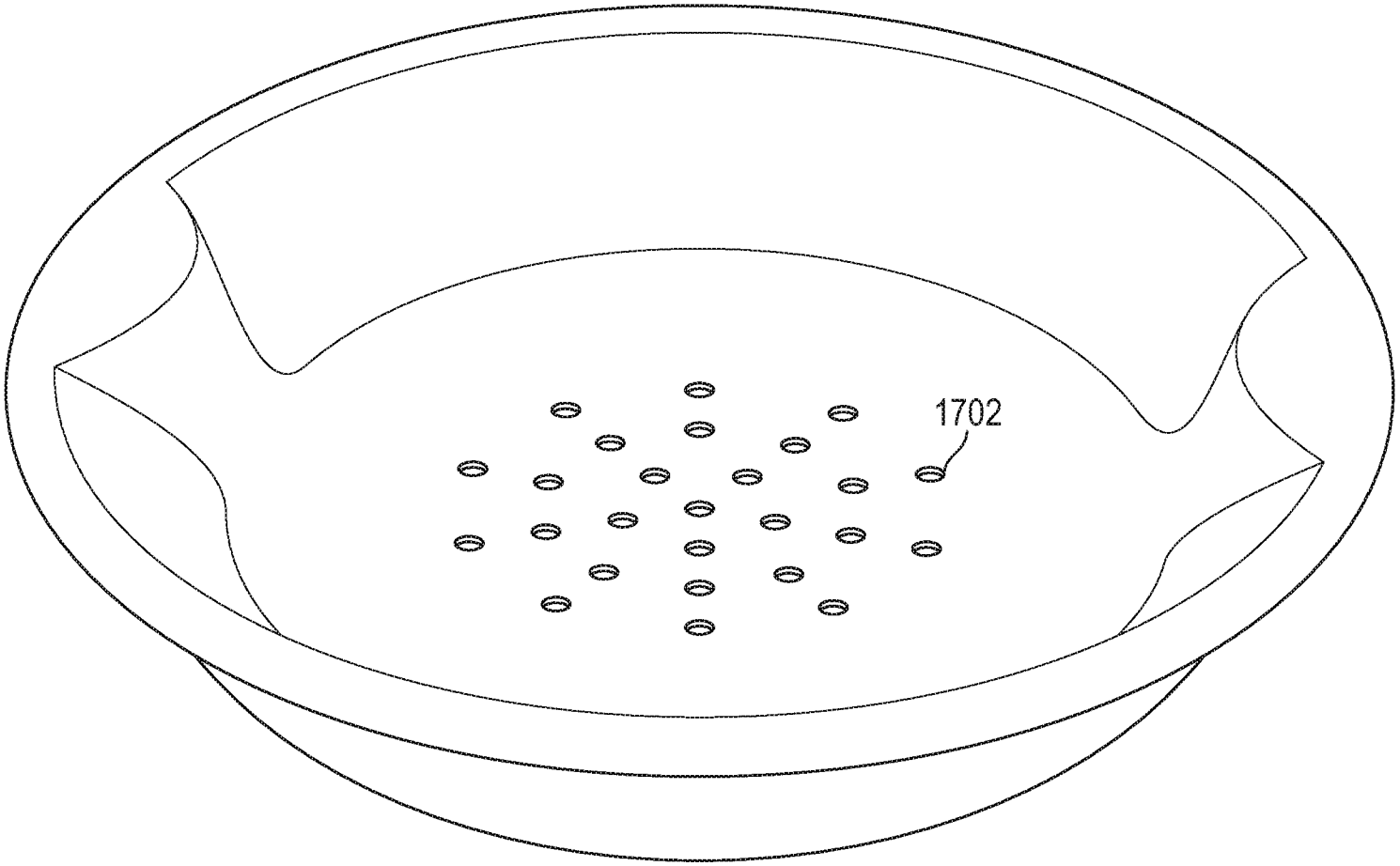
FIG. 17 depicts the steamer rack of FIG. 16 following the die cut operation in which steam holes were punched into the bottom surface of the rack in accordance with various embodiments.
Figure 18:
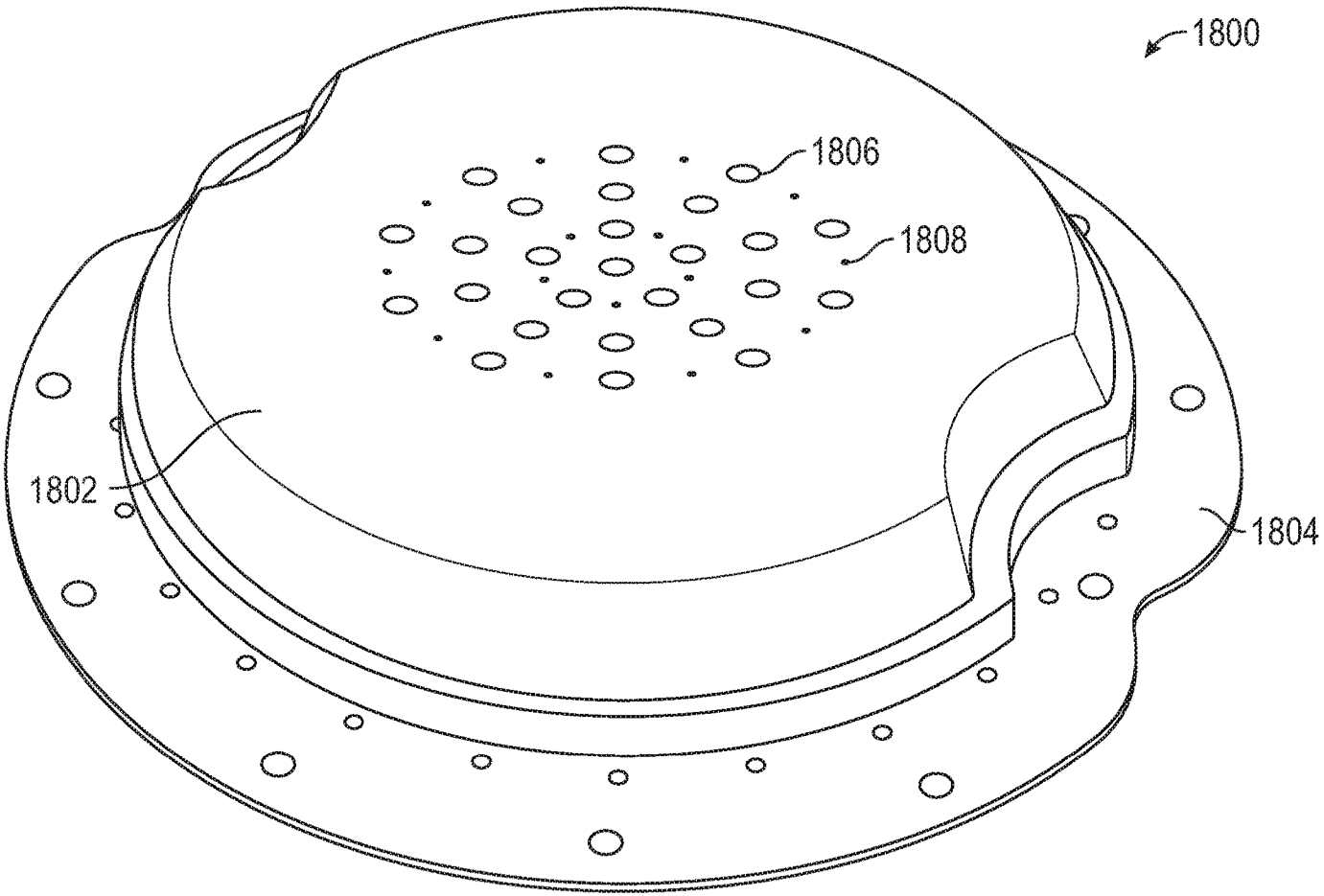
FIG. 18 is a perspective view of a convex mold form for the steamer rack of FIG. 17 in accordance with various embodiments.
Figure 20:
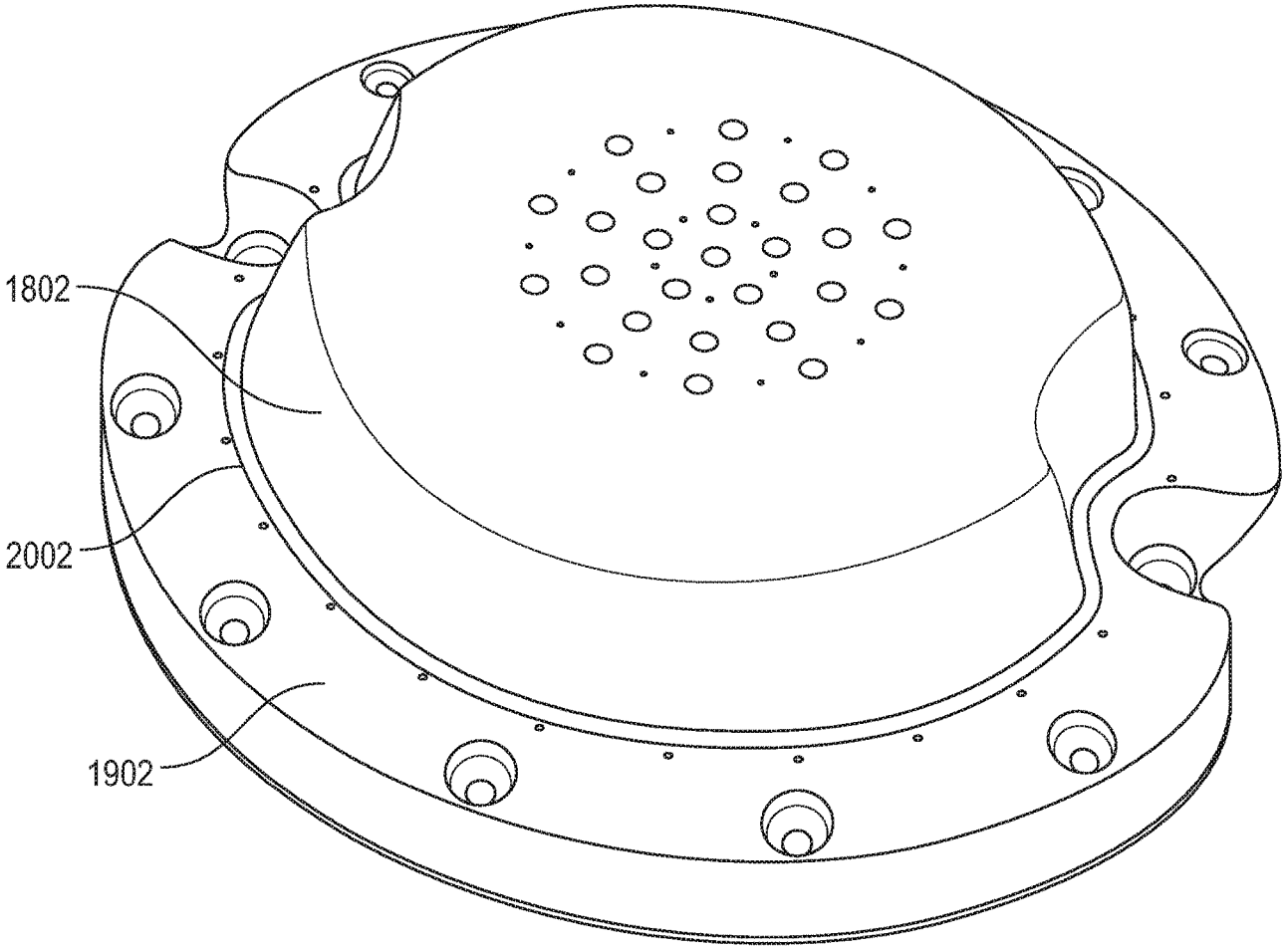
Figure 21:
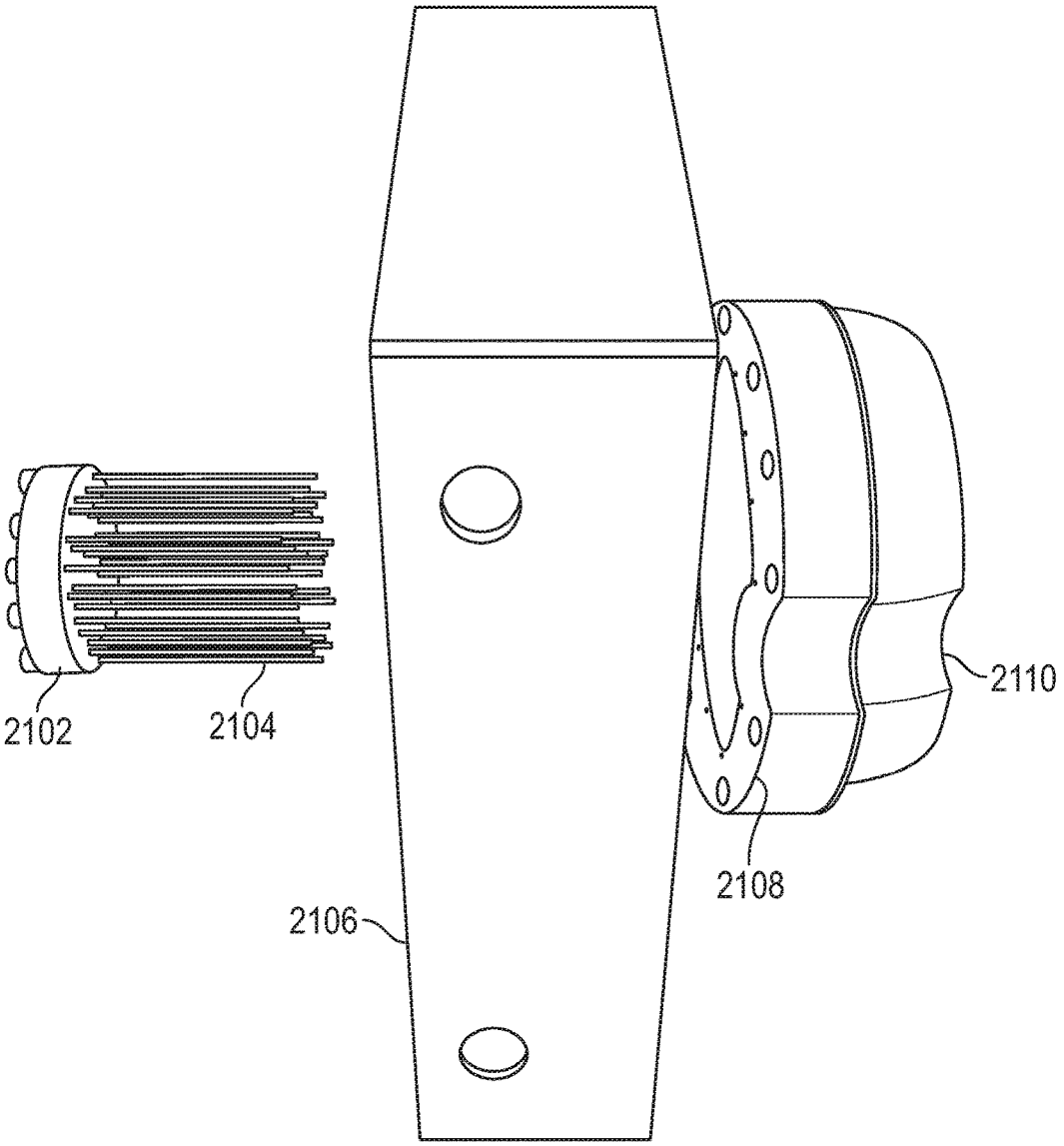

FIG. 20 shows the blade retaining ring of FIG. 18 assembled around the mold form of FIG. 17, illustrating a gap therebetween for receiving a blade in accordance with various embodiments; and FIG. 21 is a perspective view illustrating, from left to right, a punch assembly including a plurality of blades in the form of punch pins, a top die press plate, a mold form, and a molded fiber part in accordance with various embodiments.

DETAILED DESCRIPTION OF PREFERRED EXEMPLARY EMBODIMENTS

The following detailed description of the invention is merely exemplary in nature and is not intended to limit the invention or the application and uses of the invention. Furthermore, there is no intention to be bound by any theory presented in the preceding background or the following detailed description.

Various embodiments of the present invention relate to fiber-based (also referred to herein as pulp-based) products for use both within and outside of the food and beverage industry. In particular, the present disclosure relates to an in-line die cutting procedure in which a partially or fully dried molded fiber component is trimmed, punched, forged, formed, or otherwise cut following vacuum molding. This in-line die cutting technique enables fiber-based products to replace their plastic counterparts in a cost effective manner for a wide variety of applications such as, for example: frozen, refrigerated, and non-refrigerated foods; medical, pharmaceutical, and biological applications; microwavable food containers; beverages; comestible and non-comestible liquids; substances which liberate water, oil, and/or water vapor during storage, shipment, and preparation (e.g., cooking); horticultural applications including consumable and landscaping/gardening plants, flowers, herbs, shrubs, and trees; chemical storage and dispensing apparatus (e.g., paint trays); produce (including human and animal foodstuffs such as fruits and vegetables); salads; prepared foods; packaging for meat, poultry, and fish; lids; cups; bottles; guides and separators for processing and displaying the foregoing; edge and corner pieces for packing, storing, and shipping electronics, mirrors, fine art, and other fragile components; buckets; tubes; industrial, automotive, marine, aerospace and military components such as gaskets, spacers, seals, cushions, and the like.

Figure 1:
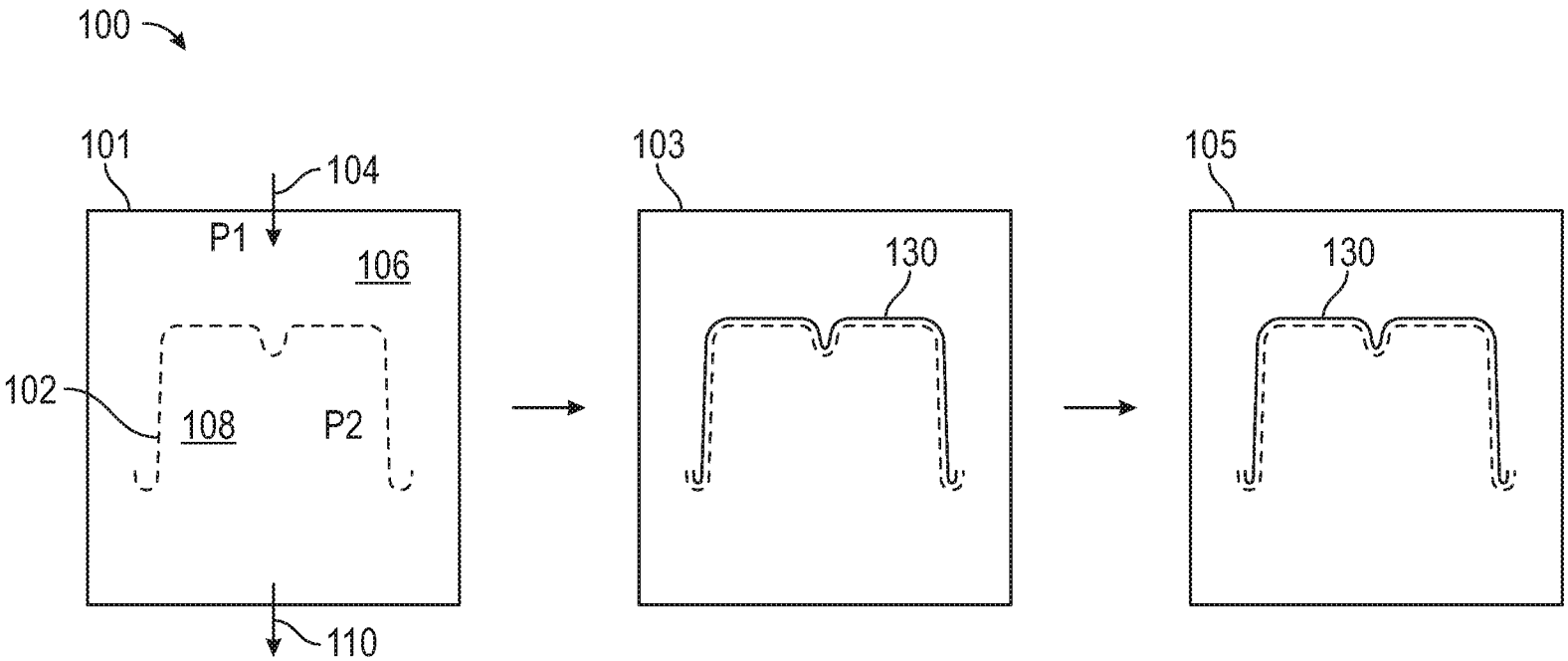
FIG. 1 is a schematic block diagram of an exemplary vacuum forming process using a fiber-based slurry in accordance with various embodiments.

Referring now to FIG. 1, an exemplary vacuum forming system and process 100 using a fiber-based slurry includes a first stage 101 in which a mold (not shown for clarity) in the form of a mirror image of the molded part to be manufactured (e.g., food bowel, steamer rack) is enveloped in a thin wire mesh 102 to match the contour of the mold. A supply 104 of a fiber-based slurry 104 is input at a pressure (P1) 106 (typically ambient pressure). By maintaining a lower pressure (P2) 108 inside the mold, the slurry is drawn through the mesh form, trapping fiber particles in the shape of the mold, while evacuating excess slurry no for recirculation back into the system.

With continued reference to FIG. 1, a second stage 103 involves accumulating a fiber layer 130 around the wire mesh in the shape of the mold. When the layer 130 reaches a desired thickness, the mold enters a third stage 105 for either wet or dry curing. In a wet curing process, the formed part is transferred to a heated press assembly (as shown, for example, in FIGS. 3 and 7-13) and the layer 130 is compressed and dried to a desired thickness, thereby yielding a smooth external surface finish for the finished part. In various embodiments, the press assembly includes components to facilitate drying the molded part, as well as components for further fabricating the molded part. In the context of the present invention, the further fabricating typically involves in-line die cutting, wherein "in-line" contemplates die cutting simultaneously with drying, heating, forming, or otherwise manufacturing the molded part. In a preferred embodiment, the same die press includes hardware for air drying, heating, die cutting, and/or pressure forming the molded product.

In accordance with various embodiments the vacuum mold process is operated as a closed loop system, in that the unused slurry is re-circulated back into the bath where the product is formed. As such, some of the chemical additives (discussed in more detail below) are absorbed into the individual fibers, and some of the additive remains in the water-based solution. During vacuum formation, only the fibers (which have absorbed some of the additives) are trapped into the form, while the remaining additives are re-circulated back in vacuum tank. Consequently, only the additives captured in the formed part must be replenished, as the remaining additives are re-circulated with the slurry in solution. As described below, the system maintains a steady state chemistry within the vacuum tank at predetermined volumetric ratios of the constituent components comprising the slurry.

Figure 2:
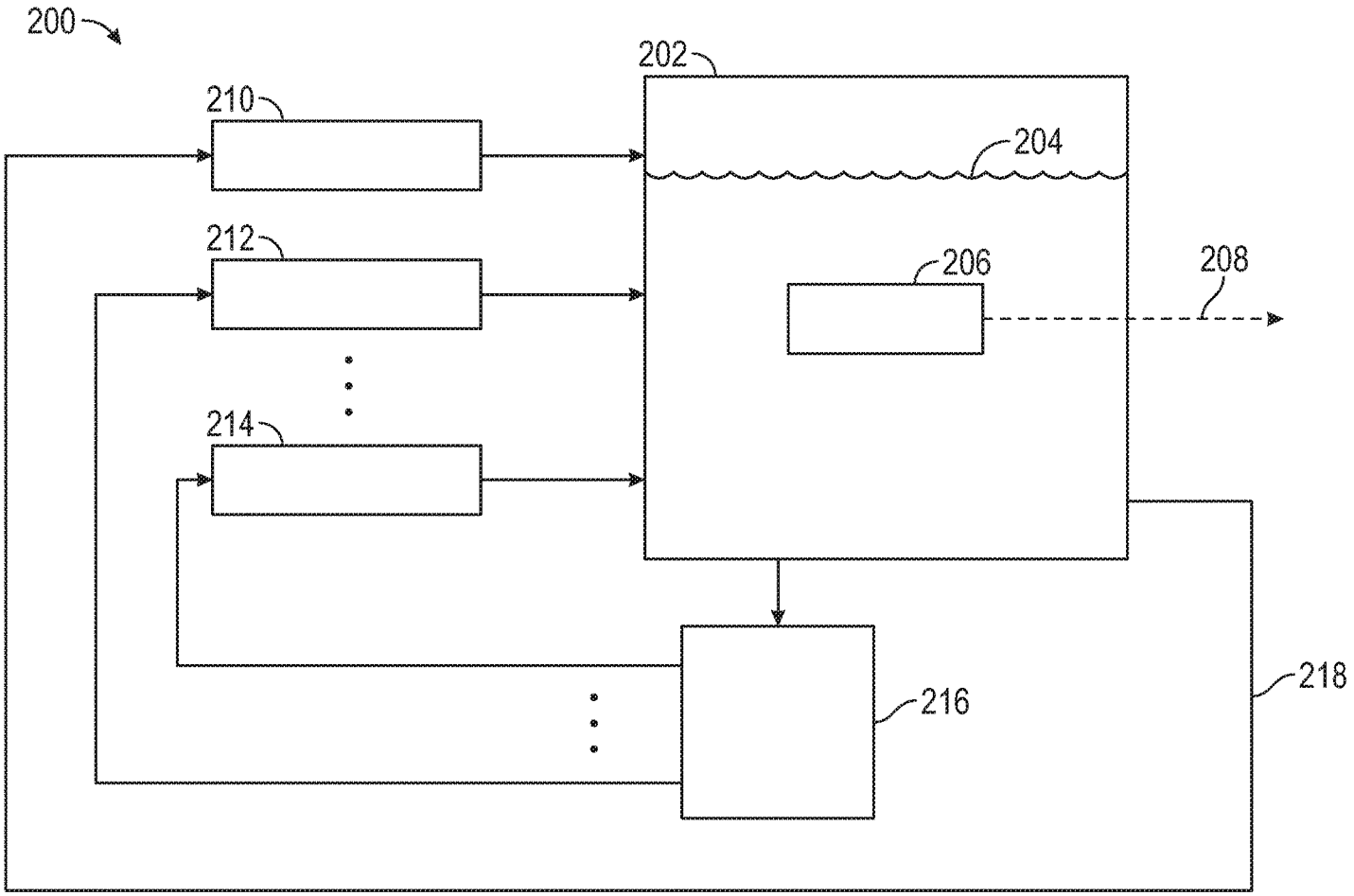
FIG. 2 is a schematic block diagram of an exemplary closed loop slurry system for controlling the chemical composition of the slurry in accordance with various embodiments.

Referring now to FIG. 2, is a closed loop slurry system 200 for controlling the chemical composition of the slurry. In the illustrated embodiment a tank 202 is filled with a fiber-based slurry 204 having a particular desired chemistry, whereupon a vacuum mold 206 is immersed into the slurry bath to form a molded part. After the molded part is formed to a desired thickness, the mold 206 is removed for subsequent processing 208 (e.g., forming, heating, drying, top coating, and the like).

In a typical wet press process, the Hot Press Temperature Range is around 150-250 degree C., with a Hot Press Pressure Range around 140-170 kg/cm$^2$. The final product density should be around 0.5-1.5 g/cm$^3$, and most likely around 0.9-1.1 g/cm$^3$. Final product thickness is about 0.3-1.5 mm, and preferably about 0.5-0.8 mm.

With continued reference to FIG. 2, a fiber-based slurry comprising pulp and water is input into the tank 202 at a slurry input 210. In various embodiments, a grinder may be used to grind the pulp fiber to create additional bonding sites. One or more additional components or chemical additives may be supplied at respective inputs 212-214. The slurry may be re-circulated using a closed loop conduit 218, adding additional pulp and/or water as needed. To maintain a steady state balance of the desired chemical additives, a sampling module 216 is configured to measure or otherwise monitor the constituent components of the slurry, and dynamically or periodically adjust the respective additive levels by controlling respective inputs 212-214. Typically the slurry concentration is around 0.1-1%, most ideally around 0.3-0.4%. In one embodiment, the various chemical constituents are maintained at a predetermined desired percent by volume; alternatively, the chemistry may be maintained based on percent by weight or any other desired control modality.

The pulp fiber used in 202 can also be mechanically grinded to improve fiber-to-fiber bonding and improve bonding of chemicals to the fiber. In this way the slurry undergoes a refining process which changes the freeness, or drainage rate, of fiber materials. Refining physically modifies fibers to fibrillate and make them more flexible to achieve better bonding. Also, the refining process can increases tensile and burst strength of the final product. Freeness, in various embodiments, is related to the surface conditions and swelling of the fibers. Freeness (csf) is suitably within the range of 200-700, and preferably about 220-250 for many of the processes and products described herein.

Figure 3:
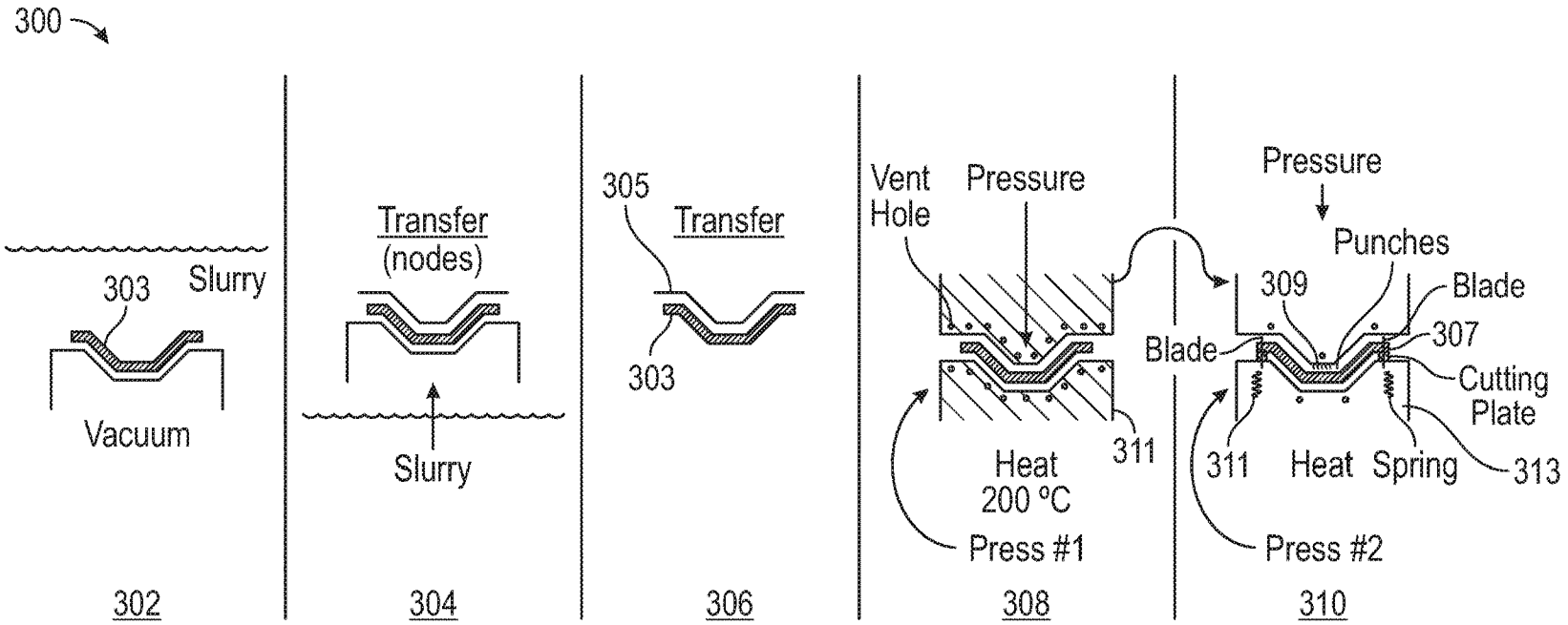
FIG. 3 is a schematic block diagram view of exemplary steps and associated die press hardware for removing a molded fiber part from a slurry bath, and simultaneously drying and die cutting the formed part accordance with various embodiments.

Referring now to FIG. 3, exemplary steps and associated hardware for removing a molded fiber part from a slurry bath, and thereafter drying and die cutting the formed part are described. More particularly, a system 300 includes a first stage 302 in which a molded fiber part 303 (e.g., a microwave bowel, steam rack, meat tray, beverage lid, produce container) is vacuum formed in a slurry bath. In stage 304, the part 303 is removed from the slurry bath, and transferred (e.g., by being vacuum drawn) to a press plate 305 (stage 306). In stage 308 the molded fiber part 303 is heated under pressure in a first press 311. In a stage 310 the part 303 is die cut in a second press 313 which may be equipped with a mechanism (e.g., springs 313) for selectively extending a blade to thereby cut off a perimeter portion 307 of the part 303, as described in greater detail below. as also described below, one or both of the presses 311, 313 may include punches 309 for forming steam holes in the bottom of the part 303, as desired.

Figure 4:
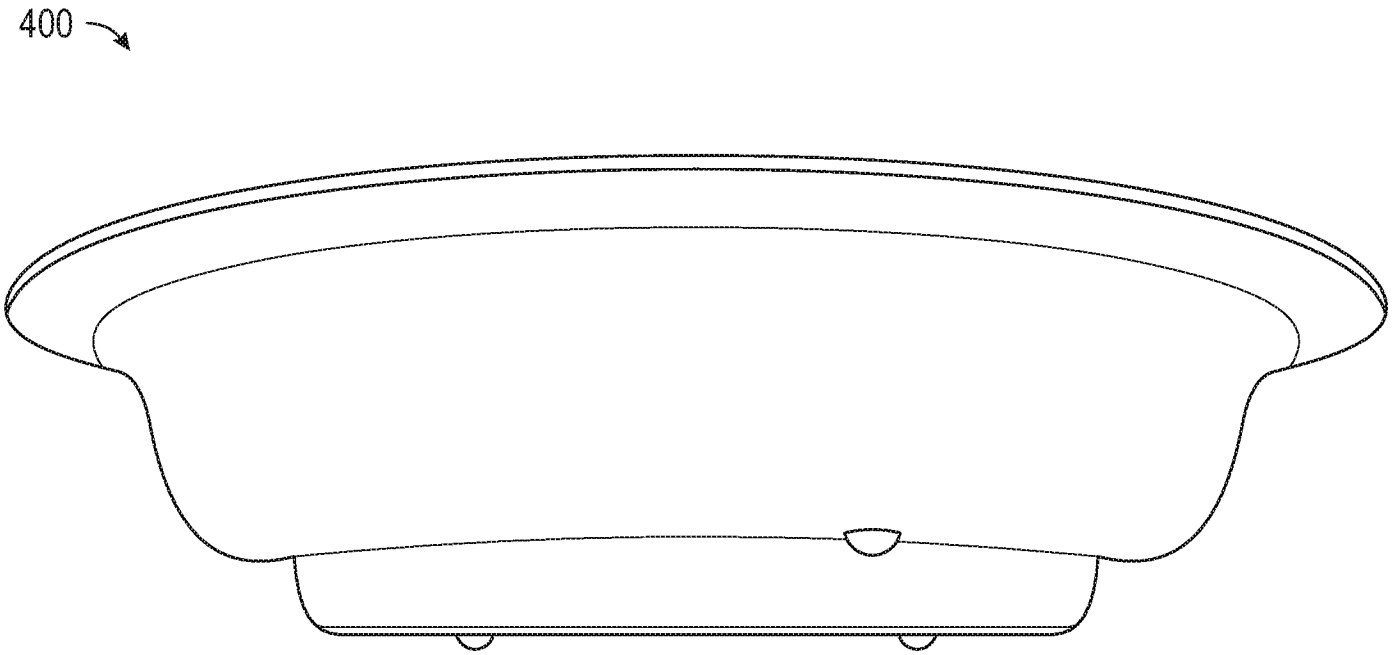
FIG. 4 is a perspective view of an exemplary bowel shaped molded fiber food container as it appears following the vacuum forming stage of manufacture, showing the convex bottom portion of the bowel in accordance with various embodiments.

With reference to FIG. 4, molded fiber parts such as a bowel shaped food container 400 may be die cut or otherwise configured while the part is being dried or heated subsequent to the vacuum forming stage of manufacture.

Figure 5:
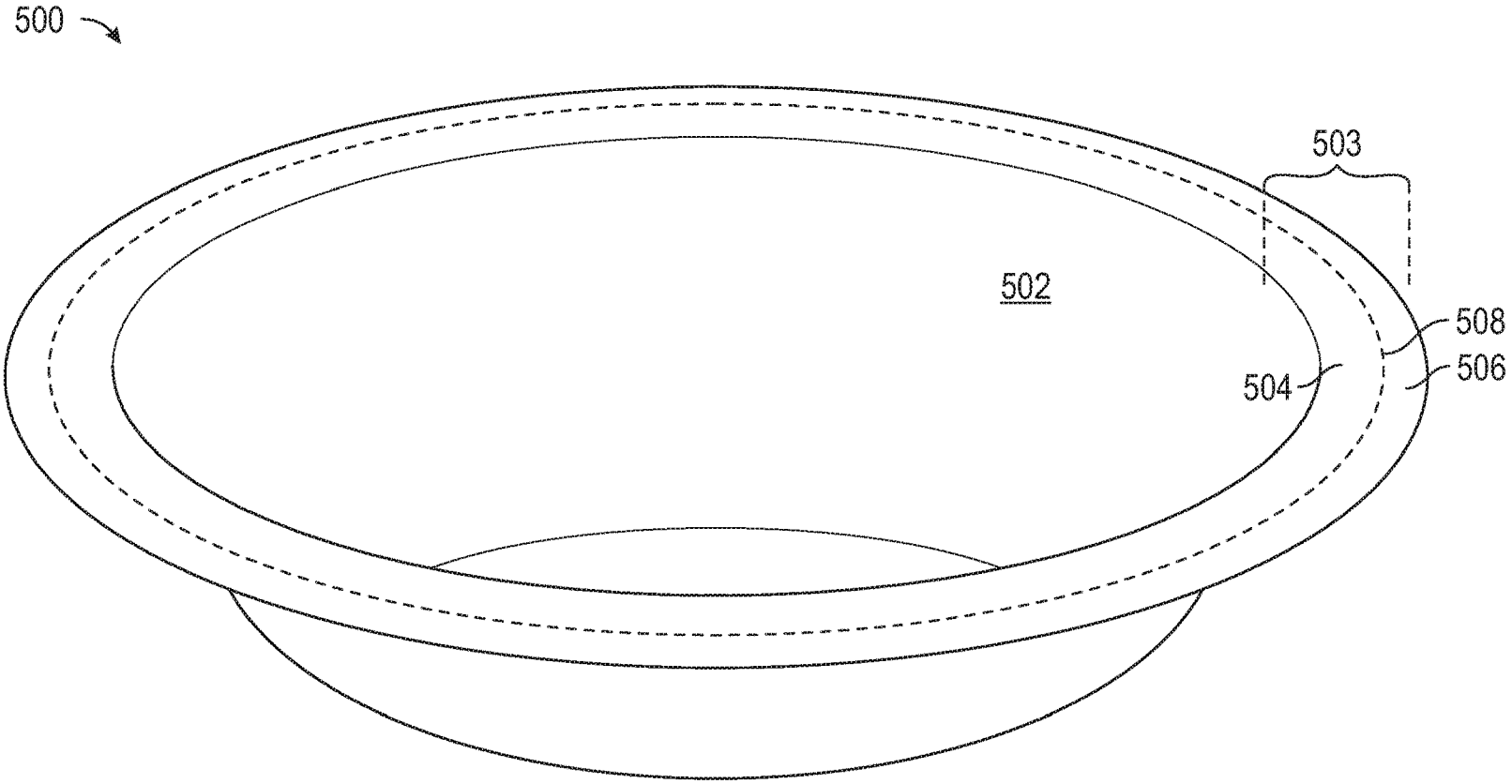
FIG. 5 is a perspective view of the food container of FIG. 4, showing the concave inside portion of the bowel and the excess circumferential ring to be removed in a subsequent in-line die cut operation in accordance with various embodiments.

For example, FIG. 5 illustrates a part 500 after it has been vacuum formed and, optionally, at least partially dried. The part 500 includes a concave inside portion 502, and an upper lip portion 503 including an inner ring 504 and an excess circumferential ring 506, where the excess ring 506 is configured to be removed in a subsequent in-line die cut operation. Specifically, the die cut procedure is configured to cut the lip along the dotted line 508, such that the excess circumferential ring 506 may be discarded. Although the illustrated embodiment depicts an outer ring to be removed in a cutting operation, those skilled in the art will appreciate that the present invention contemplates cutting, punching, folding, perforating, or further fabricating the part in any desired manner.

Figure 6:
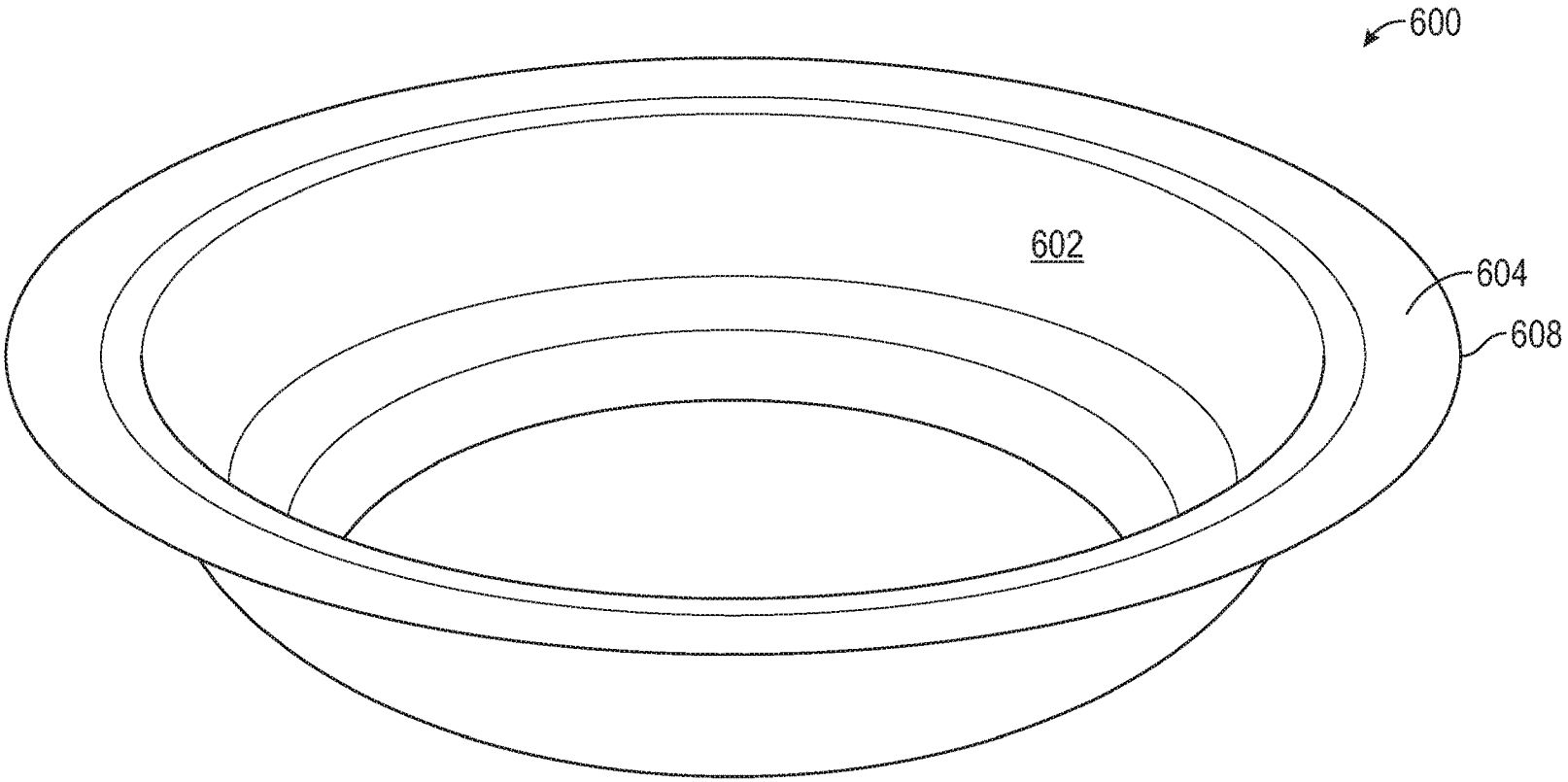
FIG. 6 is a perspective view of the molded fiber part of FIG. 5, with the circumferential ring removed following the die-cutting procedure in accordance with various embodiments.

FIG. 6 shows the molded fiber part of FIG. 5, with the circumferential ring removed following the die-cutting procedure. In particular, a part 600 includes an inside portion 602 and a upper lip 604, with the excess circumferential portion (not shown) having been removed by cutting along what is now the perimeter 608.

Referring again to FIG. 3, the aforementioned in-line die cutting operations may be implemented with one or more (e.g., two) die press assemblies configured to cut, heat, dry, and/or apply pressure to the fiber molded part, as described in greater detail below in conjunction with FIGS. 7-15.

Figure 7:
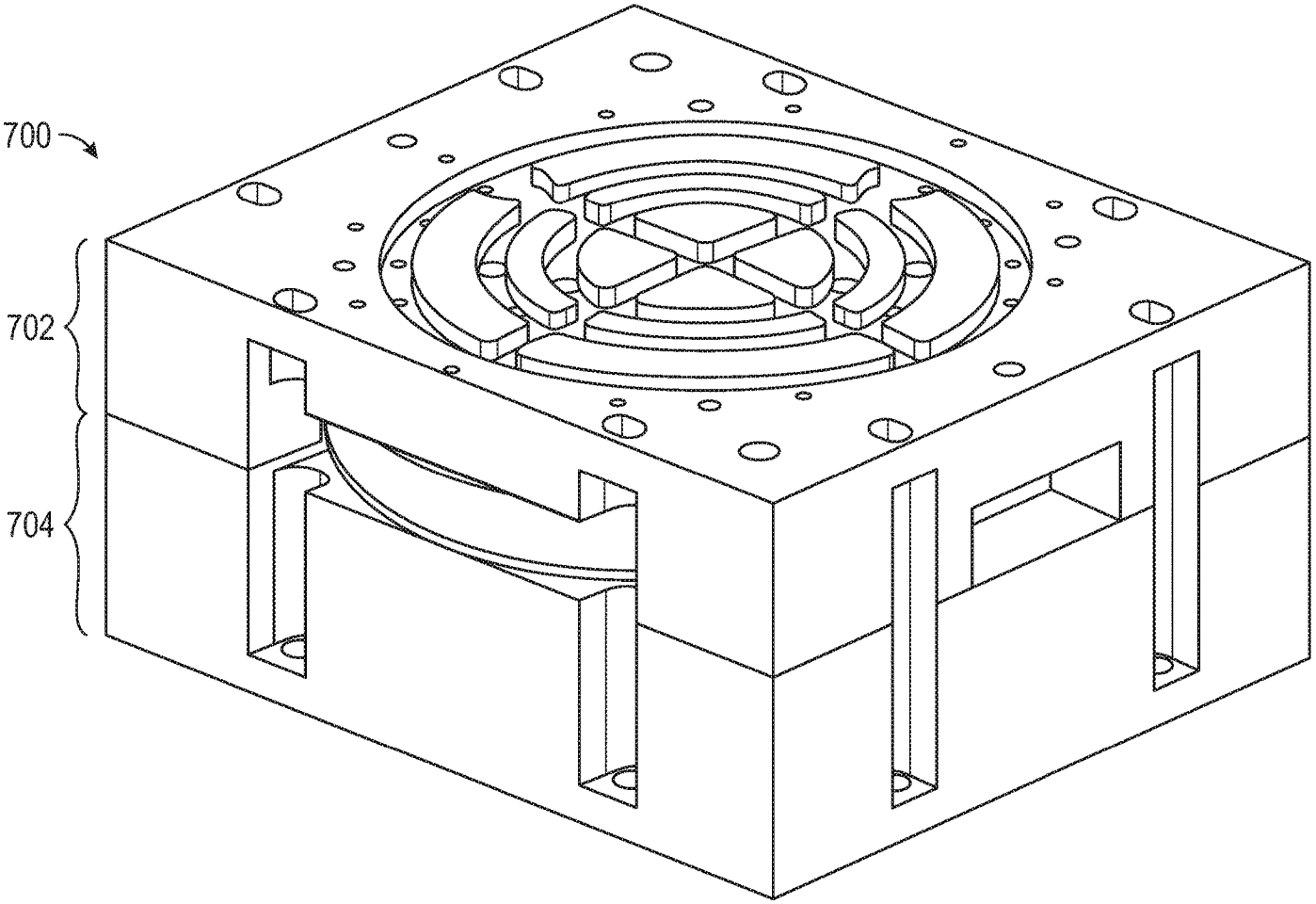
FIG. 7 is a perspective view of an exemplary die press assembly including an upper plate and an adjoining lower plate in accordance with various embodiments.

More particularly, FIG. 7 is an exemplary die press assembly 700 includes an upper plate 702 and a lower plate 704 configured to be joined to apply pressure and/or heat to the fiber molded part (not shown) sandwiched therebetween.

Figure 8:
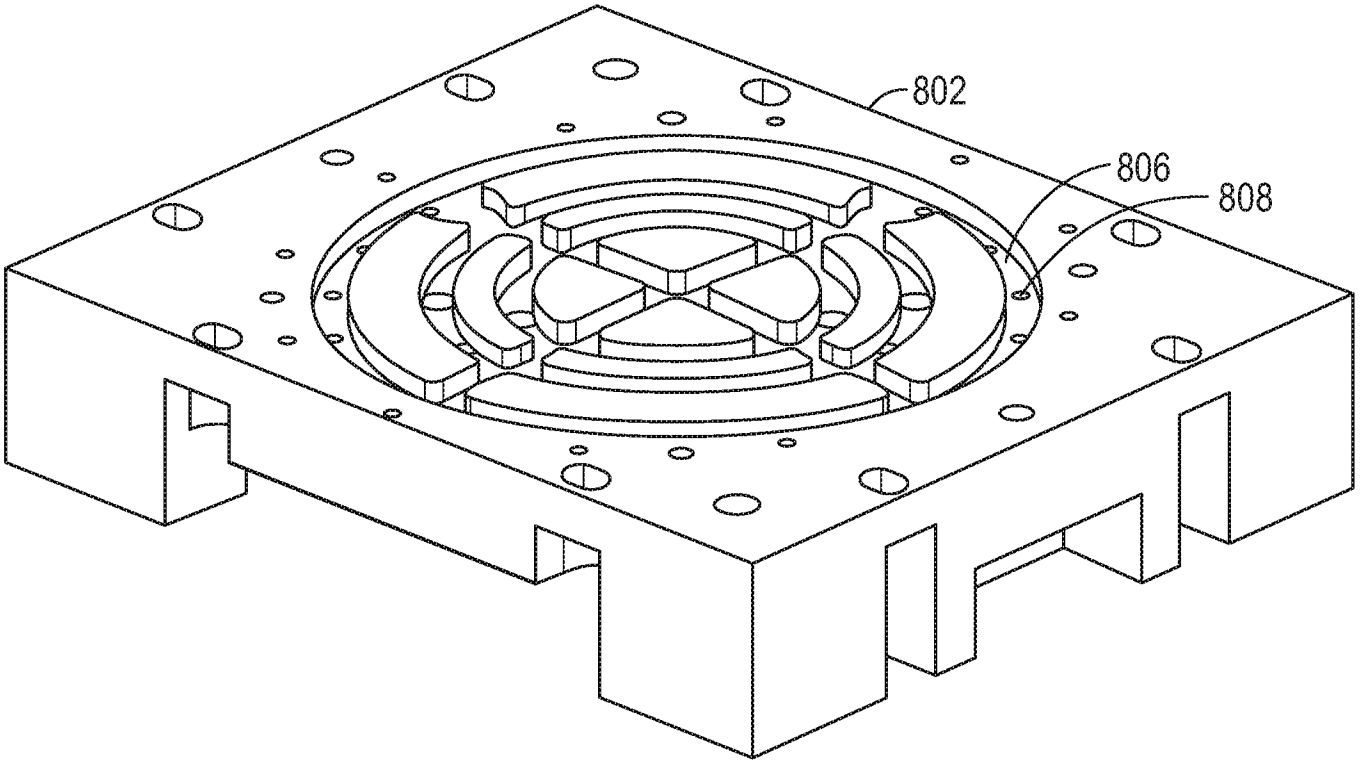
FIG. 8 is a perspective view of the top surface of the upper plate shown in FIG. 7 in accordance with various embodiments.

FIG. 8 is a perspective view of the top surface of an upper plate 802, including one or more manifolds 806 having a plurality of holes 808 configured to pass heated air through the assembly to remove moisture from the part. In addition, some or all of these holes may be configured to "toggle" between positive and negative air pressure to selectively hold and release a molded fiber part from the die plate, as described below.

Figure 9:
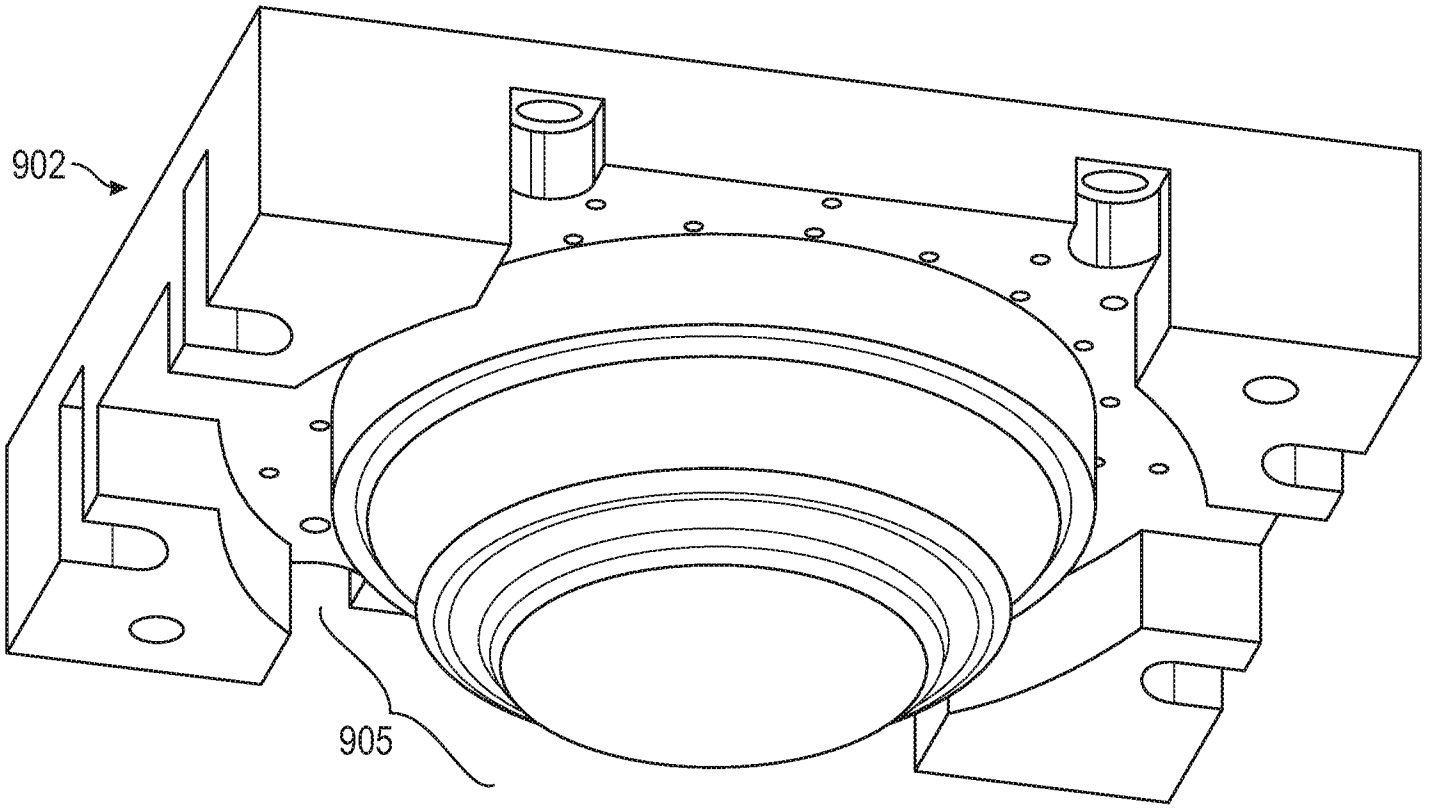
FIG. 9 is a perspective view of the convex die form on the underside of the upper plate in accordance with various embodiments.
Figure 10:
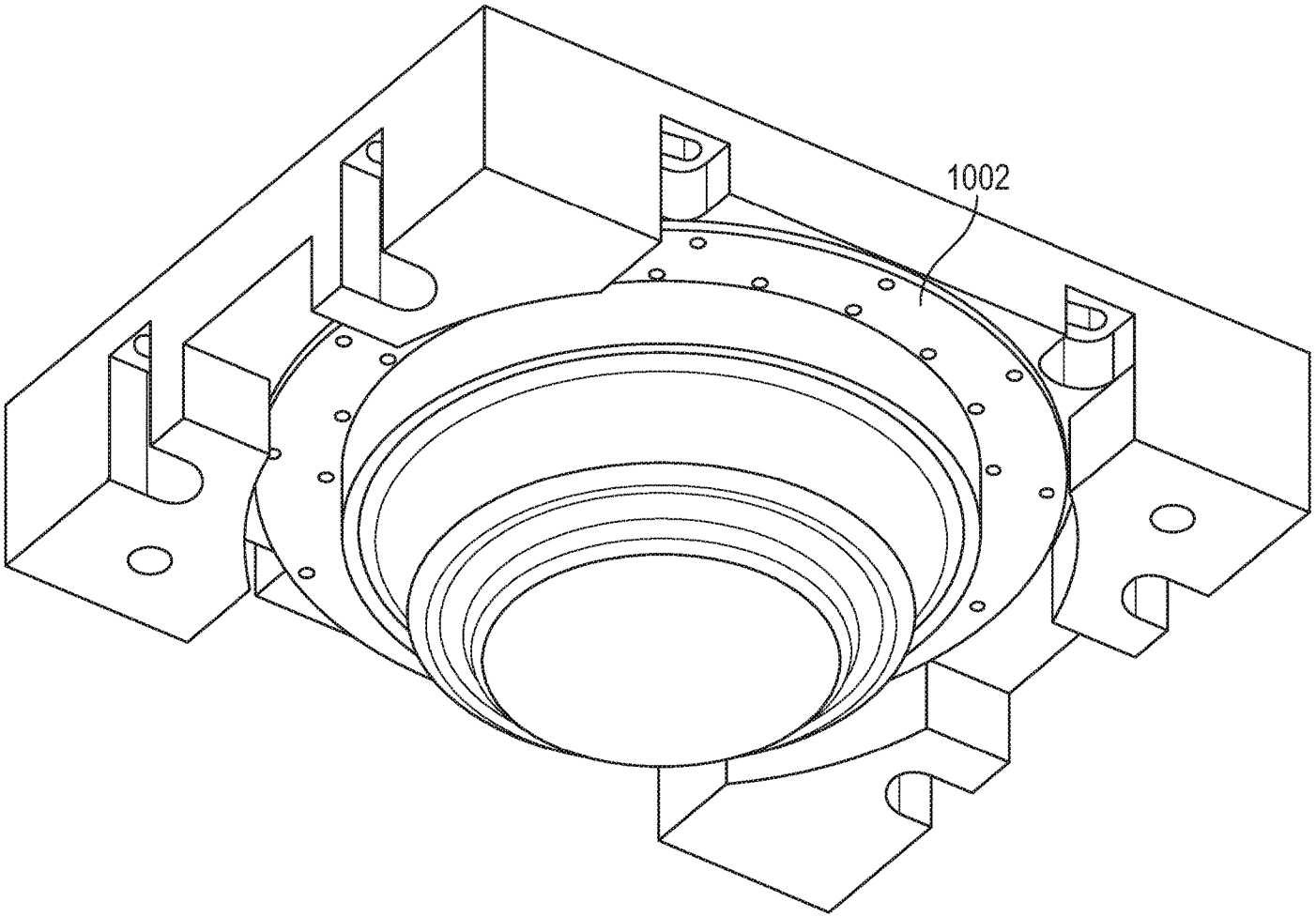
FIG. 10 is a perspective view of the upper plate shown in FIG. 9 including a support ring in accordance with various embodiments.

FIG. 9 illustrates an upper die plate 902 having a convex die form 905 on the underside of the upper plate. FIG. 10 shows the upper plate of FIG. 9 including a support ring 1002.

Figure 11:
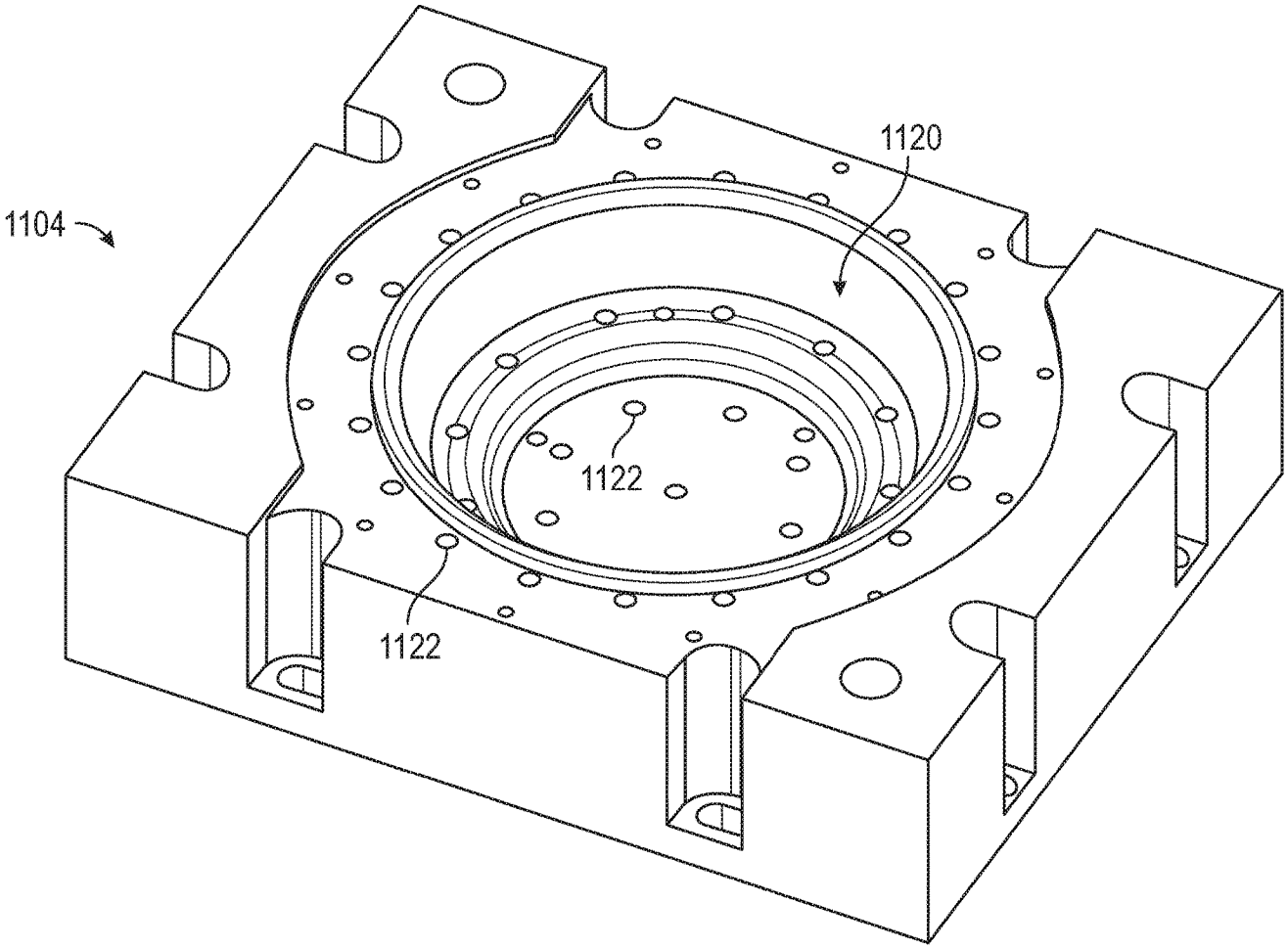
FIG. 11 is a perspective view of the concave internal region of the bottom plate of FIG. 7 in accordance with various embodiments.

Referring now to FIG. 11, a bottom die plate 1104 includes a concave internal region 1120, typically comprising a mirror image of the convex portion 905 (See FIG. 9) of the upper die plate. In this way, closing the upper and lower die plates together applies uniform pressure to the molded fiber part sandwiched between the convex die form and the corresponding concave die form. Bottom die plate 1104 further includes a plurality of vent holes 1122.

Figure 12:
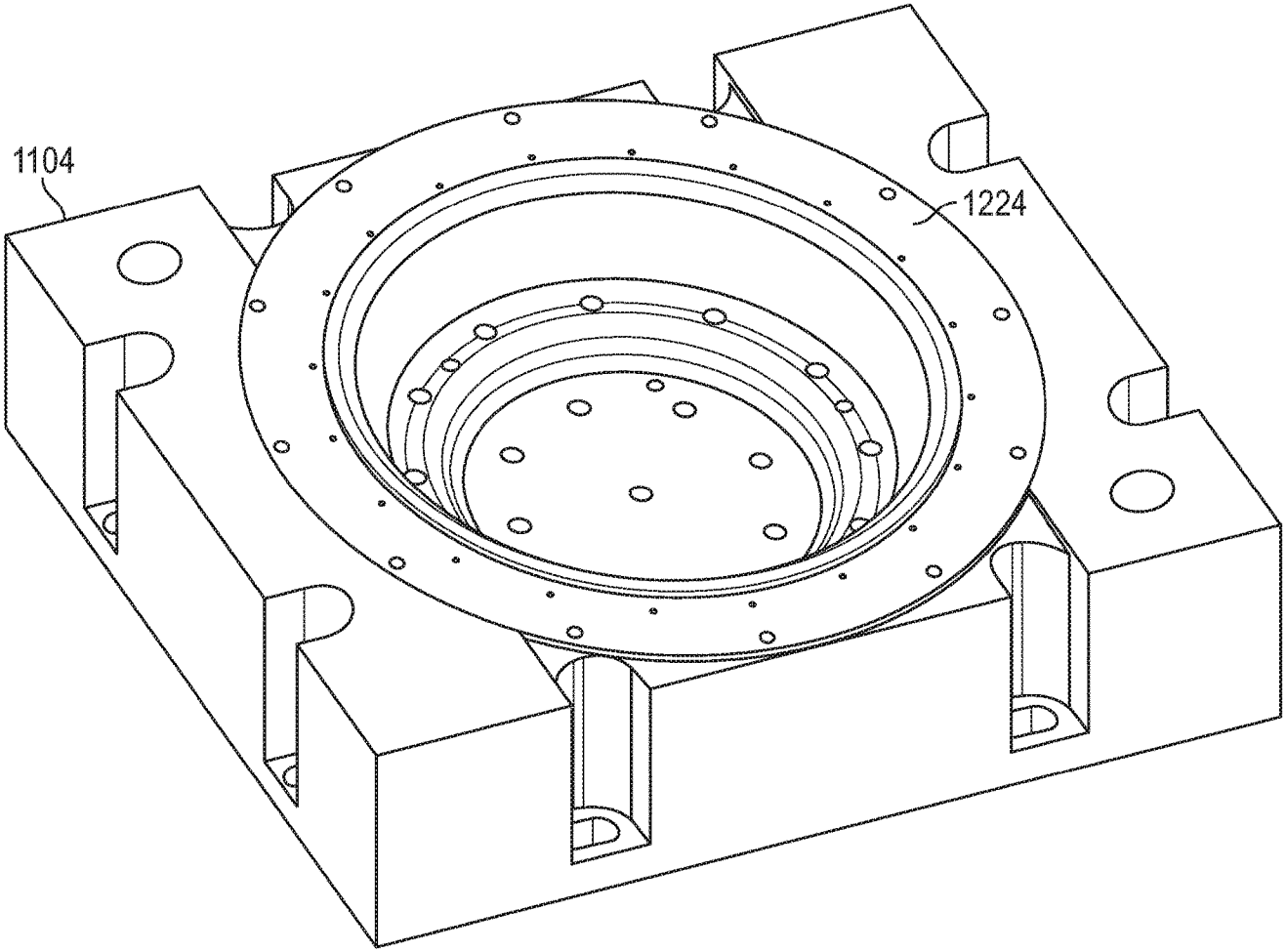
FIG. 12 illustrates the bottom plate of FIG. 11, further including a cut ring in accordance with various embodiments.
Figure 13:
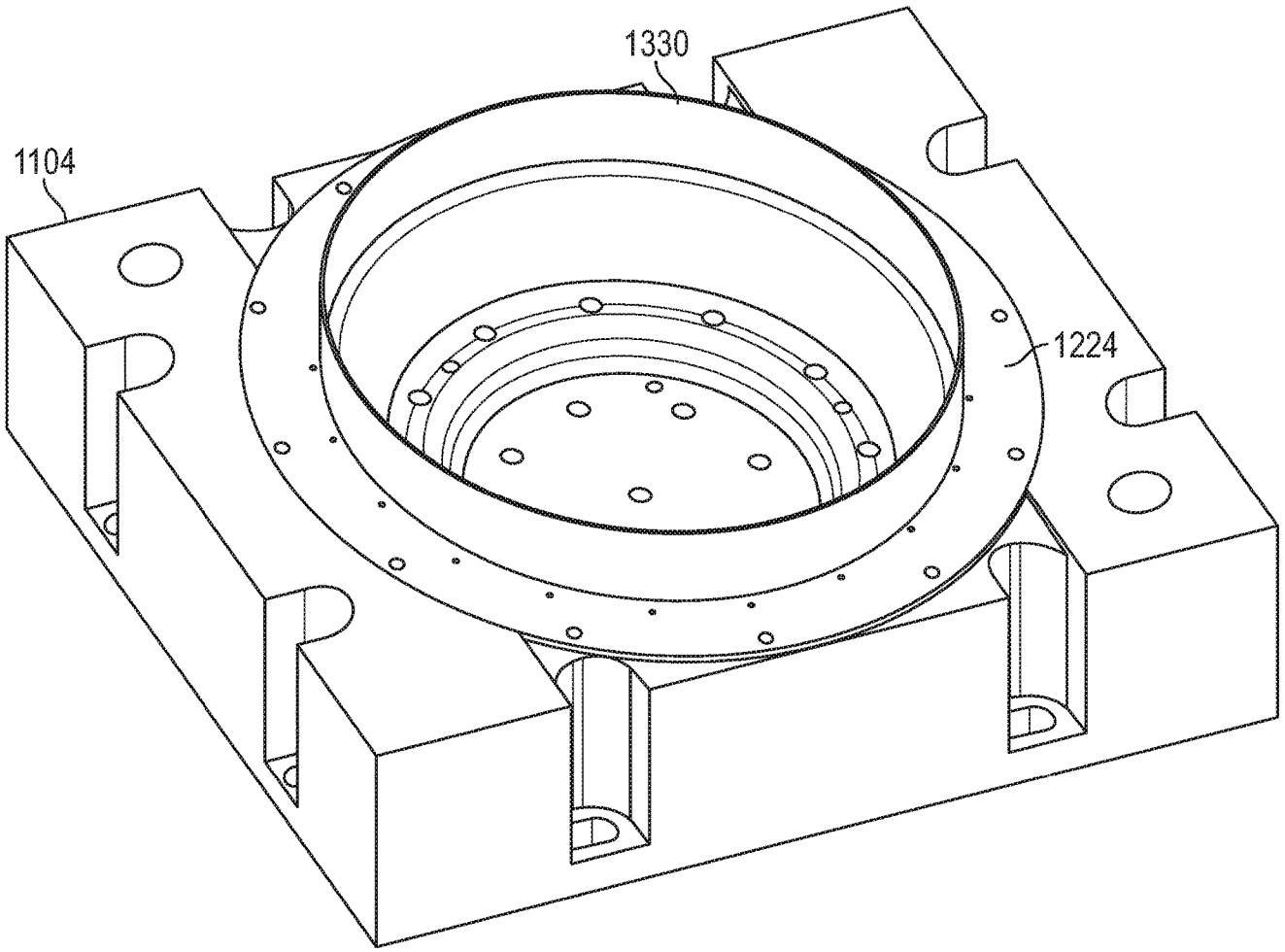
FIG. 13 shows the bottom plate of FIG. 12, further including a steel rule (blade) in accordance with various embodiments.
Figure 14:
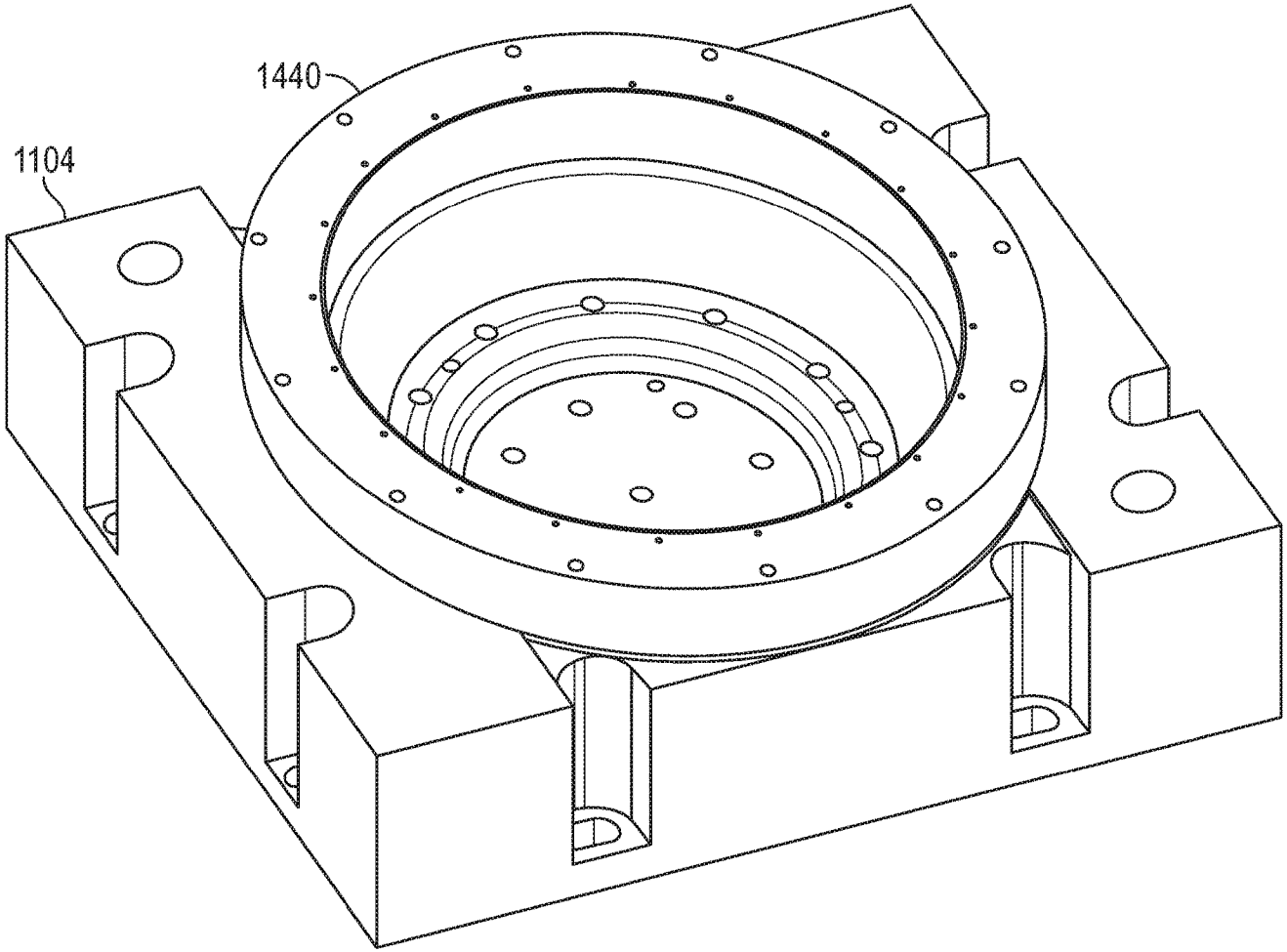
FIG. 14 shows the bottom plate shown in FIG. 13, further including a blade retaining ring in accordance with various embodiments.
Figure 15:
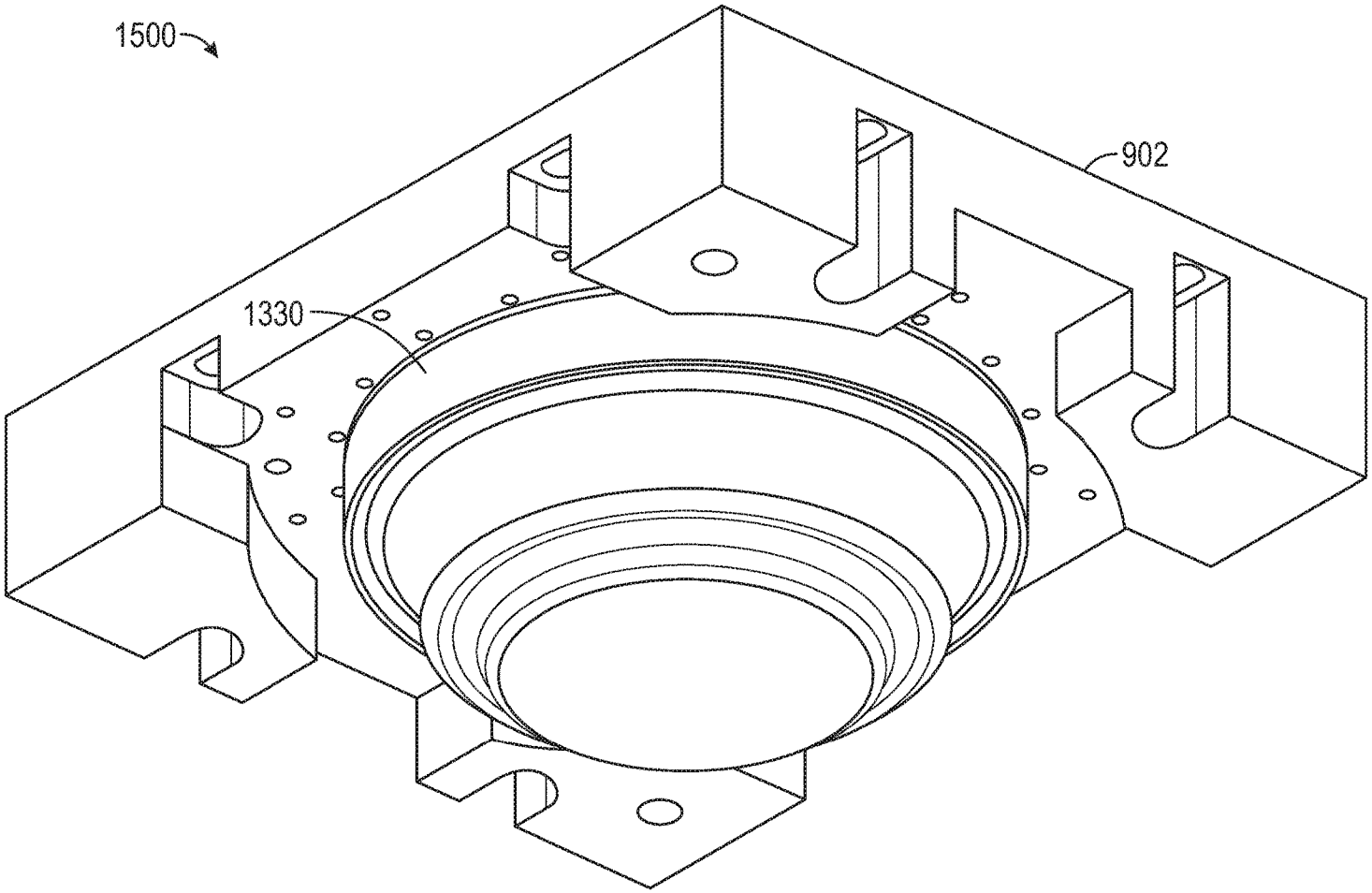
FIG. 15 is a perspective view of the top plate with the blade in the cutting position in accordance with various embodiments.

FIG. 12 illustrates the bottom plate of FIG. 11, further including a cut ring 1224 configured to facilitate the in-line die cutting of a molded fiber part (not shown in FIG. 12) contained within the die press assembly comprising the bottom plate 1104. FIG. 13 shows the bottom plate of FIGS. 11 and 12, further including a steel rule (blade) 1330 in accordance with various embodiments. FIG. 14 shows the bottom plate further including a blade retaining ring in accordance with various embodiments;

FIG. 15 is a perspective view of an upper plate assembly 1500 including the top plate 902 with the blade 1330 disposed in the cutting position, for example positioned to remove an outer perimeter ring from the lip of a bowel such as shown in FIG. 5.

Figure 16:
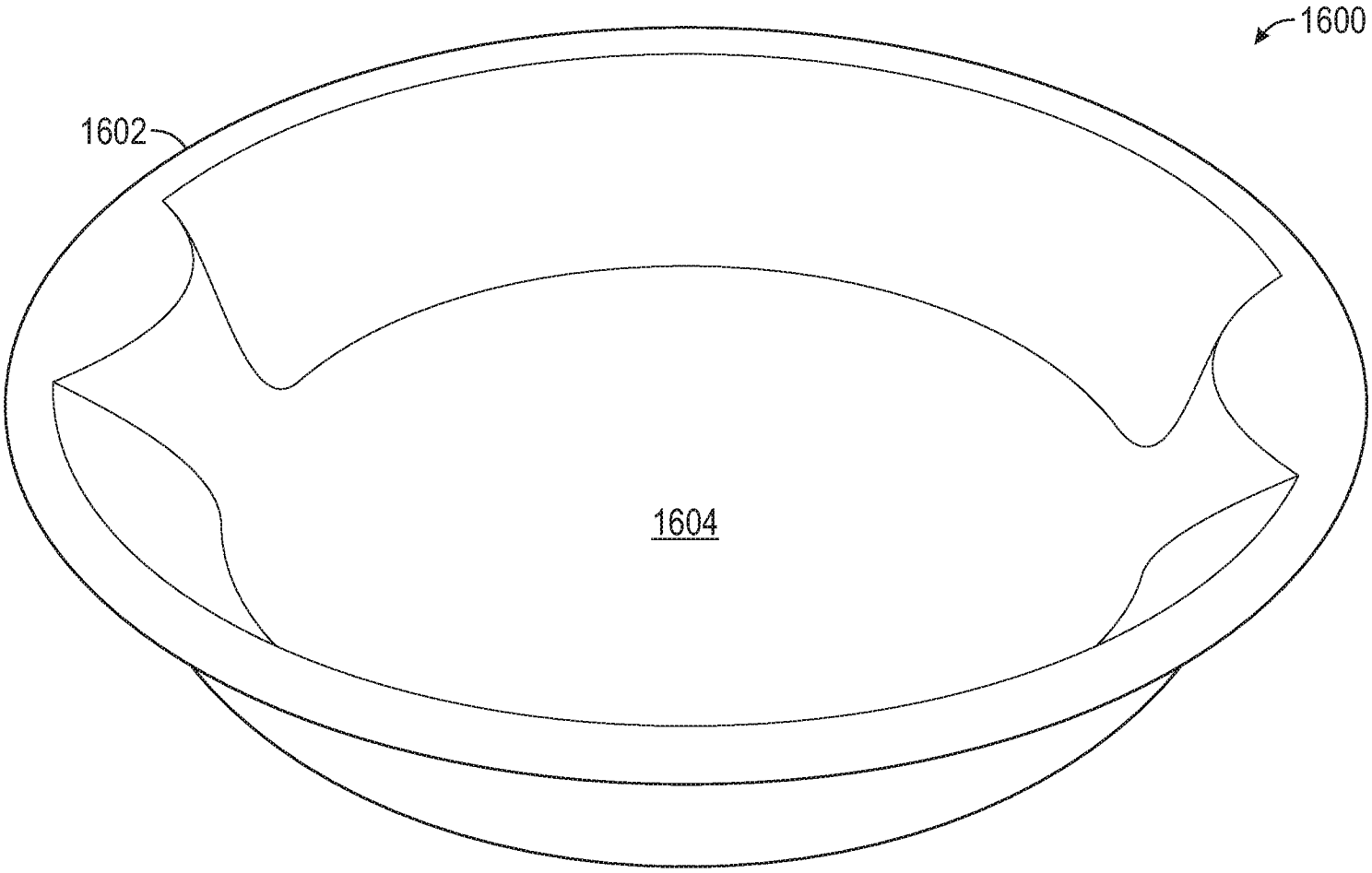
FIG. 16 is a perspective view of an exemplary molded fiber steamer rack following vacuum molding and prior to the in-line die-cutting operation in accordance with various embodiments.

In another embodiment, a microwavable bowel for steaming vegetables or other foods may be fabricated with steam holes using the principles described herein. More particularly, FIG. 16 is a perspective view of an exemplary molded fiber steamer rack 1600 following vacuum molding and prior to the in-line die-cutting operation. FIG. 17 depicts the steamer rack of FIG. 16 following the die cut operation in which a plurality of steam holes 1702 were punched into the bottom surface of the rack. Various components of the die press assembly useful in fabricating the steam holes will now be described in conjunction with FIGS. 18-21.

Figure 19:
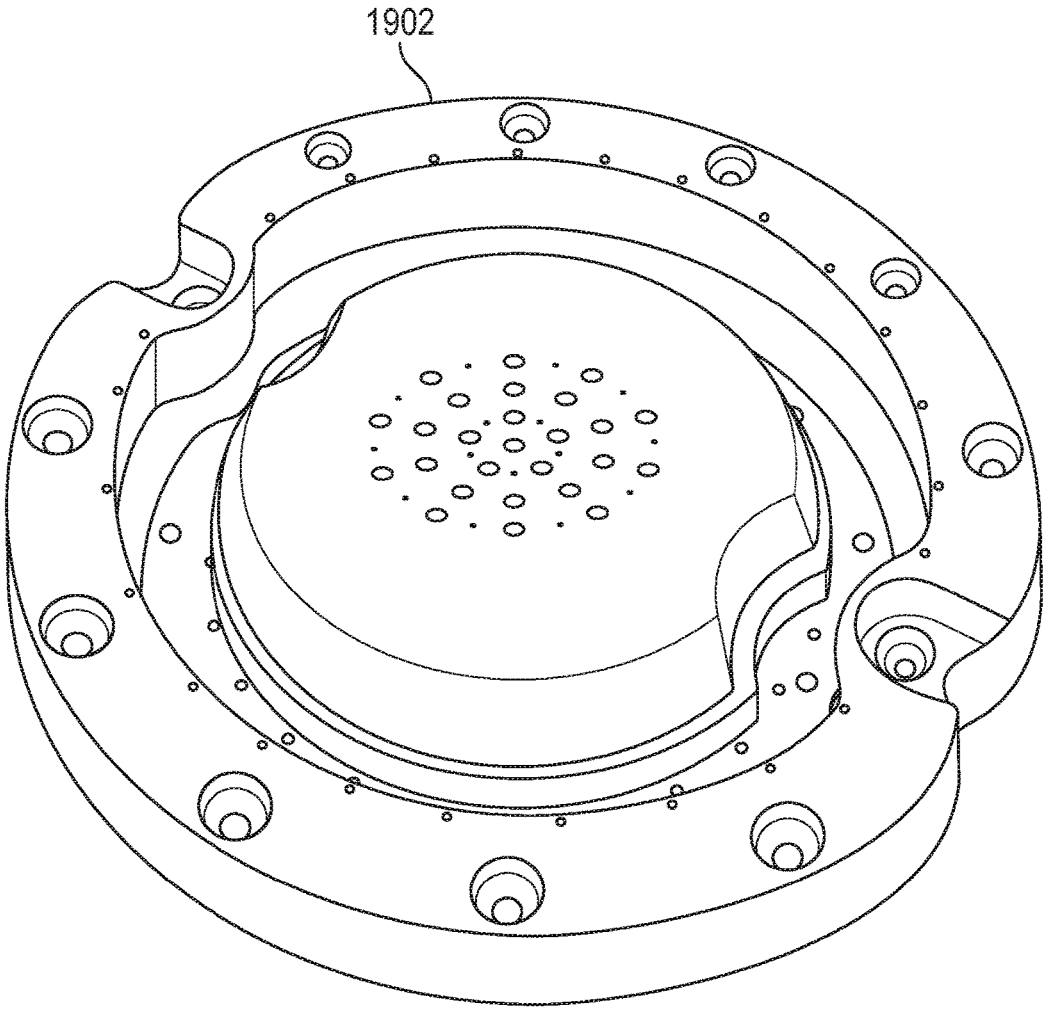
FIG. 19 is a perspective view of the mold form of FIG. 18, further including a blade retaining ring in accordance with various embodiments.

Referring now to FIG. 18, a convex mold form 1800 useful in die cutting the steamer rack of FIG. 17 includes a bowel portion 1802 a support flange 1804, a plurality of steam hole forms 1806, and a plurality of air vent holes 1808. FIG. 19 is a perspective view of the mold form of FIG. 18, further including a blade retaining ring 1902. FIG. 20 shows the blade retaining ring of FIG. 18 assembled around the mold form of FIG. 17, illustrating a gap 2002 therebetween for receiving a blade configured to remove a circumferential lip of the bowel, if desired.

FIG. 21 is an exploded view illustrating, from left to right, a punch assembly 2102 including a plurality of punch pins 2104 for creating the steam holes 1702 (See FIG. 17), a top die press plate 2106, a mold form 2108, and a molded fiber part 2110. During the die cut operation, the punch pins extend through the press plate 2106 and through the steam hole forms 1806 (FIG. 18) to create the steam holes in the finished part.

As briefly mentioned above, the die cutting operation(s) may be performed at any point after the part is removed from the slurry. Cutting the part while it retains significant moisture may require less force applied to the blade, whereas cutting the part after it is substantially or completely dried requires correspondingly more force. Moreover, it may be desirable to remove excess fiber at later processing stages to facilitate removal and/or recycling of the cut waste. In one embodiment, the cut waste may be added back into the slurry, either with or without supplemental shredding.

The various slurries used to vacuum mold containers according to the present invention may include a fiber base mixture of pulp and water, with added chemical components to impart desired performance characteristics tuned to each particular product application (e.g., moisture and/or oil barriers). The base fiber may include any one or combination of at least the following materials: softwood (SW), bagasse, bamboo, old corrugated containers (OCC), and newsprint (NP). Alternatively, the base fiber may be selected in accordance with the following resources, the entire contents of which are hereby incorporated by this reference: "Lignocellulosic Fibers and Wood Handbook: Renewable Materials for Today's Environment," edited by Mohamed Naceur Belgacem and Antonio Pizzi (Copyright 2016 by Scrivener Publishing, LLC) and available at; "Efficient Use of Fluorescent Whitening Agents and Shading Colorants in the Production of White Paper and Board" by Liisa Ohlsson and Robert Federe, Published Oct. 8, 2002 in the African Pulp and Paper Week and available at http://www.tappsa.co.za/archive/APPW2002/Title/Efficient_use_of_fluorescent_w/efficient_use_of_fluorescent_w.html; Cellulosic Pulps, Fibres and Materials: Cellucon '98 Proceedings, edited by J F Kennedy, G O Phillips, P A Williams, copyright 200 by Woodhead Publishing Ltd. and available at https://books-.google.com/books?id=xO2iAgAAQBAJ&printsec=frontcover#v=onepage&q&f=false; and U.S. Pat. No. 5,169,497 A entitled "Application of Enzymes and Flocculants for Enhancing the Freeness of Paper Making Pulp" published Dec. 8, 1992.

For vacuum molded produce containers manufactured using either a wet or dry press, a fiber base of OCC and NP may be used, where the OCC component is between 50%-100%, and preferably about 70% OCC and 30% NP, with an added moisture/water repellant in the range of 1%-10% by weight, and preferably about 1.5%-4%, and most preferably about 4%. In a preferred embodiment, the moisture/water barrier may comprise alkylketene dimer (AKD) (for example, AKD 80) and/or long chain diketenes, available from FOBCHEM at http://www.fobchem.com/html_products/Alkyl-Ketene-Dimer%EF%BC%88AKD-WAX%EF%BC%89.html#.VozozvkrKUk; and Yanzhou Tiancheng Chemical Co., Ltd. at http://www.yz-tianchengchem.com/en/index.php?m=content&c=index&a=show&catid=38&id=24&gclid=CPbn65aUg80CFRCOaQodoJUGRg.

In order to yield specific colors for molded pulp products, cationic dye or fiber reactive dye may be added to the pulp. Fiber reactive dyes, such as Procion MX, bond with the fiber at a molecular level, becoming chemically part of the fabric. Also, adding salt, soda ash and/or increase pulp temperature will help the absorbed dye to be furtherly locked in the fabric to prevent color bleeding and enhance the color depth.

To enhance structural rigidity, a starch component may be added to the slurry, for example, liquid starches available commercially as Topcat® L98 cationic additive, Hercobond, and Topcat® L95 cationic additive (available from Penford Products Co. of Cedar Rapids, Iowa). Alternatively, the liquid starch can also be combined with low charge liquid cationic starches such as those available as Penbond® cationic additive and PAF 9137 BR cationic additive (also available from Penford Products Co., Cedar Rapids, Iowa).

For dry press processes, Topcat L95 may be added as a percent by weight in the range of 0.5%-10%, and preferably about 1%-7%, and particularly for products which need maintain strength in a high moisture environment most preferably about 6.5%; otherwise, most preferably about 1.5-2.0%. For wet press processes, dry strength additives such as Topcat L95 or Hercobond which are made from modified polyamines that form both hydrogen and ionic bonds with fibers and fines. Those additives may be added as a percent by weight in the range of 0.5%-10%, and preferably about 1%-6%, and most preferably about 3.5%. In addition, wet processes may benefit from the addition of wet strength additives, for example solutions formulated with polyamide-epichlorohydrin (PAE) resin such as Kymene 577 or similar component available from Ashland Specialty Chemical Products at http://www.ashland.com/ products. In a preferred embodiment, Kymene 577 may be added in a percent by volume range of 0.5%-10%, and preferably about 1%-4%, and most preferably about 2%. Kymene 577 is of the class of polycationic materials containing an average of two or more amino and/or quaternary ammonium salt groups per molecule. Such amino groups tend to protonate in acidic solutions to produce cationic species. Other examples of polycationic materials include polymers derived from the modification with epichlorohydrin of amino containing polyamides such as those prepared from the condensation adipic acid and dimethylene triamine, available commercially as Hercosett 57 from Hercules and Catalyst 3774 from Ciba-Geigy.

In some packaging applications it is desired to allow air to flow through the container, for example, to facilitate ripening or avoid spoliation of the contents (e.g. tomatoes). However, conventional vacuum tooling typically rinses excess fiber from the mold using a downwardly directed water spry, thereby limiting the size of the resulting vent holes in the finished produce. The present inventor has determined that re-directing the spray facilitates greater fiber removal during the rinse cycle, producing a larger vent hole in the finished product for a given mold configuration.

Building on knowledge obtained from the development of the produce containers, the present inventor has determined that molded fiber containers can be rendered suitable as single use food containers suitable for use in microwave, convection, and conventional ovens by optimizing the slurry chemistry. In particular, the slurry chemistry should advantageously accommodate one or more of the following three performance metrics: i) moisture barrier; ii) oil barrier; and iii) water vapor (condensation) barrier to avoid condensate due to placing the hot container on a surface having a lower temperature tan the container. In this context, the extent to which water vapor permeates the container is related to the porosity of the container, which the present invention seeks to reduce. That is, even if the container is effectively impermeable to oil and water, it may nonetheless compromise the user experience if water vapor permeates the container, particularly if the water vapor condenses on a cold surface, leaving behind a moisture ring. The present inventor has further determined that the condensate problem is uniquely pronounced in fiber-based applications because water vapor typically does not permeate a plastic barrier.

Accordingly, for microwavable containers the present invention contemplates a fiber or pulp-based slurry including a water barrier, oil barrier, and water vapor barrier, and an optional retention aid. In an embodiment, a fiber base of softwood (SW)/bagasse at a ratio in the range of about 10%-90%, and preferably about 7:3 may be used. As a moisture barrier, AKD may be used in the range of about 0.5%-10%, and preferably about 1.5%-4%, and most preferably about 3.5%. As an oil barrier, the grease and oil repellent additives are usually water based emulsions of fluorine containing compositions of fluorocarbon resin or other fluorine-containing polymers such as UNIDYNE TG 8111 or UNIDYNE TG-8731 available from Daikin or World of Chemicals at http://www.worldofchemicals.com/chemicals/chemical-properties/unidyne-tg-8111.html. The oil barrier component of the slurry (or topical coat) may comprise, as a percentage by weight, in the range of 0.5%-10%, and preferably about 1%-4%, and most preferably about 2.5%. As a retention aid, an organic compound such as Nalco 7527 available from the Nalco Company of Naperville, Ill. May be employed in the range of 0.1%-1% by volume, and preferably about 0.3%. Finally, to strengthen the finished product, a dry strength additive such as an inorganic salt (e.g., Hercobond 6950 available at http://solenis.com/en/industries/tissue-towel/innovations/hercobond-dry-strength-additives/; see also http://www.sfm-.state.or.us/CR2K_SubDB/MSDS/HERCOBOND_6950.PDF) may be employed in the range of 0.5%-10% by weight, and preferably about 1.5%-5%, and most preferably about 4%.

Referring now to FIG. 10, an exemplary microwavable food container 1000 depicts two compartments; alternatively, the container may comprise any desired shape (e.g., a round bowl, elliptical, rectangular, or the like). As stated above, the various water, oil, and vapor barrier additives may be mixed into the slurry, applied topically as a spry on coating, or both.

Presently known meat trays, such as those used for the display of poultry, beef, pork, and seafood in grocery stores, are typically made of plastic based materials such as polystyrene and Styrofoam, primarily because of their superior moisture barrier properties. The present inventor has determined that variations of the foregoing chemistries used for microwavable containers may be adapted for use in meat trays, particularly with respect to the moisture barrier (oil and porosity barriers are typically not as important in a meat tray as they are in a microwave container).

Accordingly, for meat containers the present invention contemplates a fiber or pulp-based slurry including a water barrier and an optional oil barrier. In an embodiment, a fiber base of softwood (SW)/bagasse and/or bamboo/bagasse at a ratio in the range of about 10%-90%, and preferably about 7:3 may be used. As a moisture/water barrier, AKD may be used in the range of about 0.5%-10%, and preferably about 1%-4%, and most preferably about 4%. As an oil barrier, a water based emulsion may be employed such as UNIDYNE TG 8111 or UNIDYNE TG-8731. The oil barrier component of the slurry (or topical coat) may comprise, as a percentage by weight, in the range of 0.5%-10%, and preferably about 1%-4%, and most preferably about 1.5%. Finally, to strengthen the finished product, a dry strength additive such as Hercobond 6950 may be employed in the range of 0.5%-10% by weight, and preferably about 1.5%-4%, and most preferably about 4%.

As discussed above in connection with the produce containers, the slurry chemistry may be combined with structural features to provide prolonged rigidity over time by preventing moisture/water from penetrating into the tray.

While the present invention has been described in the context of the foregoing embodiments, it will be appreciated that the invention is not so limited. For example, the molded fiber parts may comprise any desired shape, and the die cutting may involve removing or otherwise fabricating the parts in any desired manner, wherein the associated die press mold forms and blades may be adapted to each particular part based on the teachings of the present invention.

A die press assembly is thus provided for fabricating a molded fiber part. The die press assembly includes: a first plate having a first mold form and a first plurality of vent holes; and a second plate having a second mold form and a second plurality of vent holes; wherein: at least one of the first and second plates comprises a blade operable to cut the part; the die press assembly is configured to compress the molded fiber part between the first and second mold forms; and the first and second pluralities of vent holes are configured to remove moisture from the part.

In an embodiment, the first and second pluralities of vent holes are configured to remove moisture from the part while the blade cuts the part.

In an embodiment, the first and second pluralities of vent holes are configured to heat the part to a temperature in the range of 150 to 250 degrees Centigrade.

In an embodiment, the first mold form comprises a convex portion and the second mold form comprises a concave portion.

In an embodiment, the blade is configured to cut the part after the part is partially dried but before the part is fully dried.

In an embodiment, the assembly also includes a retaining ring configured to support the blade during cutting.

In an embodiment, one of the first and second plates is configured to receive the part from a vacuum forming slurry tank.

In an embodiment, the part comprises an excess portion, and the blade is configured to remove the excess portion from the part.

In an embodiment, the part comprises a circumferential lip, and the excess portion comprises a perimeter of the circumferential lip.

In another embodiment, the part comprises a bottom surface, and the blade comprises a plurality of punch pins configured to form a plurality of holes in the bottom surface.

In an embodiment, the assembly also includes a spring mechanism configured to extend the blade into the part, and thereafter retract the blade from the part.

In an embodiment, the assembly also includes a manifold configured to force heated air through the first plurality of vent holes.

In an embodiment, the part comprises a food container; the first plate comprises an upper plate and the first mold form comprises a convex portion; the second plate comprises a lower plate and the second mold form comprises a concave portion; and at least a subset of the first plurality of vent holes are configured to toggle between positive and negative air pressure to selectively retain and exhaust the part from the upper plate.

In an embodiment, the first plate is configured to retrieve the part from or transfer the part to a third plate having a concave mold form portion and a third plurality of vent holes.

A system manufacturing system is also provided, the system including: a first press including a first plate having first vent holes, the first press configured to receive a vacuum formed molded fiber container having residual entrained water from a slurry bath; a second press including a second plate having second vent holes; and a transfer plate configured to transfer the container from the first press to the second press; wherein at least one of the first and second presses includes a die cutting blade.

In an embodiment, at least one of the first and second presses comprises a first mold form, and the transfer plate comprises a corresponding mold form configured to compress the part between the first and second mold forms.

In an embodiment, the blade is configured to remove an excess portion of the part.

In an embodiment, the first and second vent holes are configured to move heated air through the part to remove the moisture therefrom.

In an embodiment, the blade is configured to cut the part at a temperature in the range of 150 to 250 degrees Centigrade and while the part is compressed.

A die press assembly is also provided, the assembly including: a first press configured to receive a wet molded part from a fiber-based slurry tank and dry the molded part using forced air; and a second press configured to receive the molded part from the first press and to remove an excess portion of the part with a blade.

As used herein, the word "exemplary" means "serving as an example, instance, or illustration." Any implementation described herein as "exemplary" is not necessarily to be construed as preferred or advantageous over other implementations, nor is it intended to be construed as a model that must be literally duplicated.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

The invention claimed is:

1. A die press assembly for fabricating a molded fiber part, the assembly comprising:

a first plate having a first mold form and a first plurality of vent holes; and a second plate having a second mold form and a second plurality of vent holes;

wherein:

at least one of the first and second plates comprises a blade operable to cut the part;

the die press assembly is configured to compress the molded fiber part between the first and second mold forms; and the first and second pluralities of vent holes are configured to remove moisture from the part.

2. The assembly of claim 1, wherein the first and second pluralities of vent holes are connected to a vacuum source and configured to remove moisture from the part while the blade cuts the part.

3. The assembly of claim 2, wherein the first and second pluralities of vent holes are configured to facilitate heating the part to a temperature in the range of 150 to 250 degrees Centigrade.

4. The assembly of claim 1, wherein the first mold form comprises a convex portion and the second mold form comprises a concave portion.

5. The assembly of claim 1, wherein the blade is configured to cut the part after the part is partially dried but before the part is fully dried.

6. The assembly of claim 1, further comprising a retaining ring configured to support the blade during cutting.

7. The assembly of claim 1, wherein one of the first and second plates is configured to receive the part from a slurry tank used to vacuum form the part.

8. The assembly of claim 1, wherein the part comprises an excess portion, and further wherein the blade is configured to cut the part and thereby remove the excess portion from the part.

9. The assembly of claim 1, wherein the part comprises a circumferential lip, and the excess portion comprises an outer perimeter region of the circumferential lip.

10. The assembly of claim 1, wherein the part comprises a bottom surface, and the blade comprises a plurality of punch pins configured to form a plurality of holes in the bottom surface.

11. The assembly of claim 1, further comprising a spring mechanism configured to extend the blade into the part, and thereafter retract the blade from the part.

12. The assembly of claim 1, further comprising a manifold configured to force heated air through the first plurality of vent holes.

13. The assembly of claim 1, wherein:

the part comprises a food container;

the first plate comprises an upper plate and the first mold form comprises a convex portion;

the second plate comprises a lower plate and the second mold form comprises a concave portion; and at least a subset of the first plurality of vent holes are configured to toggle between positive and negative air pressure to selectively retain and exhaust the part from the upper plate.

14. The assembly of claim 13, wherein the first plate is configured to transfer the part to a third plate having a concave mold form portion and a third plurality of vent holes.

* * * * *